US008343288B2

(12) United States Patent
Murakami et al.

(10) Patent No.: US 8,343,288 B2
(45) Date of Patent: Jan. 1, 2013

(54) COLD ROLLED STEEL SHEET

(75) Inventors: Toshio Murakami, Kobe (JP); Akira Ibano, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 248 days.

(21) Appl. No.: 12/919,159

(22) PCT Filed: Mar. 6, 2009

(86) PCT No.: PCT/JP2009/054326

§ 371 (c)(1),
(2), (4) Date: Aug. 24, 2010

(87) PCT Pub. No.: WO2009/110607

PCT Pub. Date: Sep. 11, 2009

(65) Prior Publication Data

US 2011/0005643 A1 Jan. 13, 2011

(30) Foreign Application Priority Data

Mar. 7, 2008 (JP) ..... 2008-057319
Mar. 7, 2008 (JP) ..... 2008-057320
Mar. 10, 2008 (JP) ..... 2008-059854
Apr. 3, 2008 (JP) ..... 2008-097411

(51) Int. Cl.
*C22C 38/44* (2006.01)

(52) U.S. Cl. ..... 148/335; 148/330; 148/331; 148/332; 148/336

(58) Field of Classification Search ..... 148/320–337, 148/405, 559, 579–664, 500, 503–507; 420/8, 420/83–86, 89–93, 103–121, 123, 124, 129, 420/590

See application file for complete search history.

(56) References Cited

U.S. PATENT DOCUMENTS 7,090,731 B2 * 8/2006 Kashima et al. ..... 148/320

(Continued)

FOREIGN PATENT DOCUMENTS

JP 2002 161336 6/2002

(Continued)

OTHER PUBLICATIONS

U.S. Appl. No. 13/257,639, filed Sep. 20, 2011, Hata et al.

(Continued)

*Primary Examiner* — Scott Kastler
*Assistant Examiner* — Vanessa Luk
(74) *Attorney, Agent, or Firm* — Oblon, Spivak, McClelland, Maier & Neustadt, L.L.P.

(57) ABSTRACT

Provided are the following cold-rolled steel sheets: 1) a cold-rolled steel sheet having higher stretch flangeability than conventional steels; 2) a cold-rolled steel sheet having a higher balance between elongation and stretch flangeability than conventional steels; and 3) a cold-rolled steel sheet heightened in all of yield stress, elongation, and stretch flangeability. The cold-rolled steel sheets are characterized by containing 0.03-0.30 mass % carbon, up to 3.0 mass % (including 0 mass %) silicon, 0.1-5.0 mass % manganese, up to 0.1 mass % phosphorus, less than 0.01 mass % sulfur, up to 0.01 mass % nitrogen, and 0.01-1.00 mass % aluminum and having a structure which comprises tempered martensite in an amount of 50% or more (including 100%) in terms of areal proportion and in which the remainder is ferrite. The steel sheets are further characterized in that at least one of the following structural factors has been regulated: the proportions of cementite particles and of the ferrite grains in the tempered martensite and the dislocation density in all structures.

27 Claims, 7 Drawing Sheets

U.S. PATENT DOCUMENTS

| | | | | |
|---|---|---|---|---|
| 2003/0084966 | A1 * | 5/2003 | Ikeda et al. | 148/320 |
| 2009/0277547 | A1 | 11/2009 | Saito et al. | |

FOREIGN PATENT DOCUMENTS

| | | |
|---|---|---|
| JP | 2004 232022 | 8/2004 |
| JP | 2004 256872 | 9/2004 |
| JP | 2005 171321 | 6/2005 |
| JP | 2005 213603 | 8/2005 |
| JP | 2005 273002 | 10/2005 |
| JP | 2007 009253 | 1/2007 |
| JP | 2007 138262 | 6/2007 |
| WO | 2008 007785 | 1/2008 |

OTHER PUBLICATIONS

U.S. Appl. No. 13/258,823, filed Sep. 22, 2011, Murakami et al.
Kinoshita, Masayuki et al., "Hot Rolled High Strength Steel Sheets with High Stretch Flangeability for Automotive Use", NKK Technical Report, vol. 145, pp. 1-8, (1994).
U.S. Appl. No. 12/742,323, filed May 11, 2010, Murakami et al.

* cited by examiner (a) STEEL No.1

(b) STEEL No.23

(a) STEEL No.1

(b) STEEL No.19

(a) STEEL No.30

(b) STEEL No.38

COLD ROLLED STEEL SHEET

TECHNICAL FIELD

The present invention relates to a cold rolled steel sheet, and more specifically, to a high-strength cold-rolled steel sheet excellent in formability.

BACKGROUND TECHNOLOGY

High strength intended for ensuring collision safety performance, and fuel economy due to reduction in car body weight is required of a steel sheet for use in automobile framework components, and so forth. Further, excellent formability is required of the steel sheet in order to work it into the automobile framework components that are complex in shape.

For this reason, a high-strength steel sheet having not only tensile strength (TS) on the order of 980 MPa or more but also stretch flangeability (a hole expanding ratio: λ) more enhanced than in the case of conventional steel, and a high-strength steel sheet more enhanced not only in stretch flangeability but also in total elongation (total elongation: El) have been highly desired. Further, in an application sector where stretch flangeability is anticipated to exhibit a particularly excellent effect although elongation performance is the same as in the past, a hole expanding ratio 125% or higher is desired of a high-strength steel sheet with tensile strength (TS) on the order of 980 MPa or more. Furthermore, in an application sector where enhanced performance in both the elongation, and the stretch flangeability is desired, the total elongation 13% or more, and the hole expanding ratio 90% or higher are desired of the high-strength steel sheet with tensile strength (TS) on the order of 980 MPa or more.

Further, materials designing on the basis of tensile strength (TS) has thus far been adopted, however, since it has become important to make an assessment on yield strength (YP) when collision safety is taken in consideration, a high-strength steel sheet excellent in both yield strength, and formability is now in demand. As specific mechanical characteristics of the high-strength steel sheet described as above, there desired yield strength (YP) 900 MPa or higher, total elongation (El) 10% or more, and stretch flangeability (a hole expanding ratio: λ) 90% or more, or preferably 100% or more, are desired.

In consideration of such needs as described, and on the basis of various ideas for structure control, there have been proposed a multitude of high-strength steel sheets with improvement in stretch flangeability, or balance between elongation and stretch flangeability. However, a high-strength steel sheet satisfying such desired levels as above has not been completed as yet at the present stage.

For example, in Patent Document 1, there is disclosed a high tensile-strength cold-rolled steel sheet comprising at least one element selected from the group consisting of Mn, Cr, and Mo, in total content of 1.6 to 2.5 mass %, effectively composed of a single-phase structure of martensite. With this high tensile-strength cold-rolled steel sheet, a hole expanding ratio (stretch flangeability) 100% or more is obtained while ensuring tensile-strength 980 MPa or more, but the hole expanding ratio has not reached 125% as yet, and elongation is yet to reach 10%.

In Patent Document 2, there is disclosed a high tensile-strength steel sheet composed of a dual-phase structure of ferrite 65 to 85% in area ratio, and tempered martensite in the balance. With this steel sheet, since the area ratio of ferrite is excessively high, the hole expanding ratio has not reached 90% although elongation 13% or more has been obtained.

Further, in Patent Document 3, there is disclosed a high tensile-strength steel sheet composed of a dual-phase structure wherein ferrite, and martensite each have an average grain size 2 μm or less, and martensite has a volume ratio in a range of 20 to 60%, however, the hole expanding ratio thereof is less than 90%.

Further, it is well known that, besides the constituents of a matrix structure itself, as set forth in each of Patent Documents 1 to 3, described as above, inclusions (sulfide, in particular) present in the matrix structure, as well, have significant effects on the stretch flangeability.

For example, in Non-patent Document 1, it is disclosed that, in the case of a steel sheet having tensile strength (TS) on the order of 440 to 590 MPa, reduction in the sulfur content of the steel sheet can suppress generation of inclusions, thereby improving stretch flangeability.

However, in order to reduce the sulfur content of the steel sheet down to a level lower than the present level, there will be the need for a special desulfurization treatment to be applied in a steel-making process, thereby causing deterioration in productivity, and an increase in production cost. Therefore, techniques for improvement on stretch flangeability by reduction in the sulfur content, as disclosed in Non-patent Document 1, will be difficult for application on an industrial basis.

In Patent Document 4, there is disclosed a high yield-strength and high tensile-strength cold-rolled steel sheet excellent in formability, characterized in that a steel sheet comprising C: 0.02 mass % or less, and Ti: in a range of 0.15 to 0.40 mass % is subjected to annealing at a temperature in a range of 600 to 720° C. in a carburizing atmosphere. With this steel sheet, yield-strength 900 MPa or higher, and elongation 10% or more have been obtained, but stretch flangeability is less than 90%.

[Patent Document 1] JP-A-2002-161336
[Patent Document 2] JP-A-2004-256872
[Patent Document 3] JP-A-2004-232022
[Patent Document 4] JP-A-2007-9253
[Non-patent Document 1] "NKK Technical Report", published by Nippon Koukan K. K., by Masayuki Kinoshita, et al., Vol. 145, 1994, p. 1

DISCLOSURE OF THE INVENTION

Problems to be Solved by the Invention

Under the circumstances, it is an object of the invention to provide a cold rolled steel sheet more enhanced in stretch flangeability than in the case of conventional steel while securing tensile strength, a cold rolled steel sheet more enhanced in balance between elongation, and stretch flangeability than in the case of conventional steel while securing tensile strength, or a cold rolled steel sheet enhanced in any of yield stress, elongation, and stretch flangeability.

To that end, the present invention provides a cold rolled steel sheet having a composition comprising, by mass %, 0.03 to 0.30% of C, not more than 3.0% of Si (0% included), 0.1 to 5.0% of Mn, not more than 0.1% of P, less than 0.01% of S, not more than 0.01% of N, and 0.01 to 1.00% of Al, the cold rolled steel sheet further having a structure composed of tempered martensite with an area ratio not less than 50% (100% included), and ferrite residing in the balance of the structure, wherein at least one of structure factors including cementite particles in the tempered martensite, ferrite grains, and dislocation density of the whole structure is appropriately controlled.

The object of the invention can be solved by properly controlling at least one structure factor among cementite particles in the tempered martensite, ferrite grains, and dislocation density in the whole structure. More specifically, it is possible to provide a cold rolled steel sheet more enhanced in stretch flangeability than in the case of conventional steel while securing tensile strength, a cold rolled steel sheet more enhanced in balance between elongation, and stretch flangeability than in the case of conventional steel while securing tensile strength, or a cold rolled steel sheet enhanced in any of yield stress, elongation, and stretch flangeability.

The cold rolled steel sheet more enhanced in stretch flangeability than in the case of conventional steel is the cold rolled steel sheet wherein the composition comprises, by mass %, 0.5 to 3.0% of Si, the tempered martensite has hardness not more than 380 Hv, the number of cementite particles 0.1 μm or more in diameter of an equivalent circle, present in the tempered martensite, is not more than 2.3 pieces per 1 $\mu m^2$ of the tempered martensite, and the number of inclusions not less than 2.0 in aspect ratio, present in the whole structure, is not more than 200 pieces per 1 $mm^2$ (according to a first aspect of the invention).

The cold rolled steel sheet more enhanced in balance between elongation, and stretch flangeability than in the case of conventional steel is the cold rolled steel sheet wherein the composition comprises, by mass %, 0.5 to 5.0% of Mn, the tempered martensite has hardness in a range of 330 to 450 Hv, the tempered martensite has an area ratio in a range of 50 to 70%, the maximum grain size of the ferrite is not more than 12 μm in terms of the diameter of an equivalent circle, and frequency distribution of angles formed between a C-direction (a direction at right angles to a rolling direction) and the longitudinal direction of a ferrite grain, varying in increments of 10-degrees, has the maximum value not more than 18% and the minimum value not less than 6% (according to a second aspect of the invention).

The cold rolled steel sheet enhanced in any of yield stress, elongation, and stretch flangeability is the cold rolled steel sheet wherein the composition comprises, by mass %, 0.1 to 3.0% of Si, the tempered martensite has hardness not more than 380 Hv, dislocation density in the whole structure is $1\times10^{15}$ to $4\times10^{15}$ $m^{-2}$, and an Si equivalent defined by expression (1) satisfies expression (2) (according to a third aspect of the invention);

$$[\text{Si equivalent}]=[\%\ \text{Si}]+0.36[\%\ \text{Mn}]+7.56[\%\ \text{P}]+0.15[\%\ \text{Mo}]+0.36[\%\ \text{Cr}]+0.43[\%\ \text{Cu}] \quad (1),$$

and $$[\text{Si equivalent}]\geqq 4.0-5.3\times10^{-8}\sqrt{[\text{dislocation density}]} \quad (2).$$

The cold rolled steel sheet enhanced in any of yield stress, elongation, and stretch flangeability is the cold rolled steel sheet wherein the composition comprises, by mass %, 0.1 to 3.0% of Si, 1.0 to 5.0% of Mn, and 0.5 to 3.0 of Cr, the tempered martensite has an area ratio not less than 70% (100% included), an area ratio f (%) of cementite in the tempered martensite, and an average diameter Dθ (μm) of an equivalent circle of the cementite satisfy expression (3), and a calorific value generated between 400 to 600° C., as measured by a differential scanning calorimeter (DSC) is not more than 1 J/g (according to a fourth aspect of the invention);

$$(0.9f^{-1/2}-0.8)\times D\theta\leqq 6.5\times10^{-1} \quad (3)$$

where f=[% C]/6.69.

Further, the cold rolled steel sheet preferably contains by mass %, 0.01 to 1.0% of Cr. Furthermore, the cold rolled steel sheet preferably contains at least one range selected from the group consisting of ranges 1) Mo: in a range of 0.01 to 1.0 mass %, 2) Cu: in a range of 0.05 to 1.0 mass %, and/or Ni: in a range of 0.05 to 1.0 mass %, 3) Ca: in a range of 0.0005 to 0.01 mass %, and/or Mg: in a range of 0.0005 to 0.01 mass %, 4) B: in a range of 0.0002 to 0.0030 mass %, and 5) REM: in a range of 0.0005 to 0.01 mass %.

Effects of the Invention

With the present invention, in a single-phase structure of a tempered martensite, or a dual-phase structure composed of ferrite, and a tempered martensite, the at least one structure factor selected from the group consisting of the cementite particles in the tempered martensite, the ferrite grains, and the dislocation density in the whole structure is properly controlled. By so doing, it has become possible for the present invention, to provide a cold rolled steel sheet more enhanced in stretch flangeability than in the case of conventional steel while securing tensile strength, a cold rolled steel sheet more enhanced in balance between elongation, and stretch flangeability than in the case of conventional steel while securing tensile strength, or a cold rolled steel sheet enhanced in any of yield stress, elongation, and stretch flangeability.

BEST MODE FOR CARRYING OUT THE INVENTION

Figure 1:
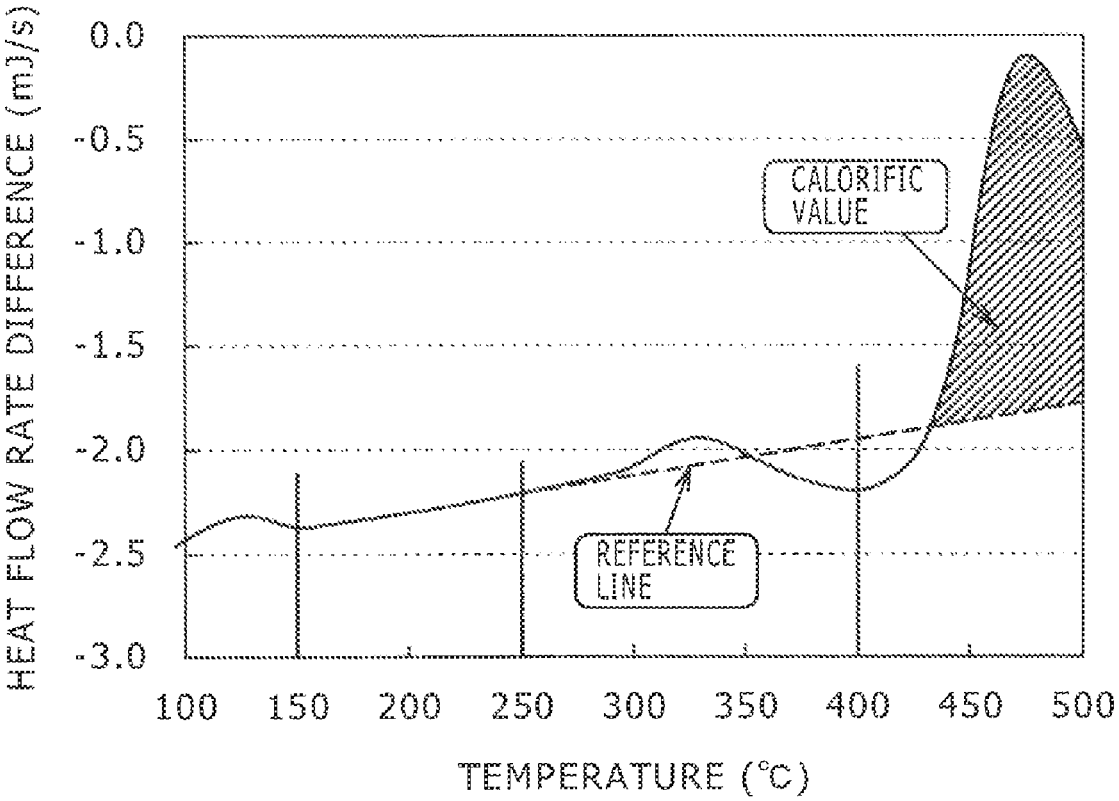
FIG. 1 is a view showing results of measurement by a differential scanning calorimeter (DSC) by way of example.

The inventor, et al. have focused attention on a high-strength steel sheet having a single-phase structure of a tempered martensite, or a dual-phase structure composed of ferrite and a tempered martensite (hereinafter referred to merely as martensite where appropriate), and they have continued strenuous studies thereon.

As a result, the inventor, et al. have found out that with a cold rolled steel sheet having a composition comprising 0.03 to 0.30 mass % of C, 3.0 mass % or less (including 0 mass %)

of Si, 0.1 to 5.0 mass % of Mn, 0.1 mass % or less of P, less than 0.01 mass % of S, 0.01 mass % or less of N, and 0.01 to 1.00 mass % of Al, and having a structure composed of a tempered martensite having an area ratio of not less than 50% (100% included), and ferrite residing in the balance of the structure, if one of structure factors including cementite particles in the tempered martensite, ferrite grains, and dislocation density in the whole structure is properly controlled, this will enable various problems described as above to be solved, and on the basis of such knowledge as described, they have succeeded in completing the present invention.

First, fundamental component composition of a steel sheet according to the present invention is described hereinafter.

[The Fundamental Component Composition of the Steel Sheet According to the Present Invention]

C: 0.03 to 0.30 mass %

C represents an important element affecting an area ratio of martensite, and an amount of cementite precipitated in martensite, thereby having effects on strength and stretch flangeability of a steel sheet. If a C content is less than 0.03 mass %, it will be impossible to secure strength, whereas if a C content is in excess of 0.30 mass %, martensite will be excessively high in hardness, so that it will be impossible to secure stretch flangeability. The C content is preferably in a range of 0.05 to 0.25 mass %, more preferably in a range of 0.07 to 0.20 mass %

Si: 3.0 Mass % or Less (Including 0 Mass %)

Si represents a useful element capable of enhancing tensile strength by solid solution reinforcement without causing deterioration in elongation and stretch flangeability. If an Si content is in excess of 3.0 mass %, this will block formation of austenite at the time of heating, so that it will be impossible to secure an area ratio of martensite, resulting in failure to secure stretch flangeability.

Mn: 0.1 to 5.0 mass %

Mn represents a useful element for securing an area ratio of martensite, the element being capable of enhancing tensile strength by solid solution reinforcement, and enhancing hardenability of a steel sheet, thereby having effects of promoting generation of a low-temperature transformation phase. If an Mn content is less than 0.1 mass %, it will be impossible to strike a good balance between elongation and stretch flangeability, whereas if the Mn content is in excess of 5.0 mass %, residual austenite will remain at the time of quenching (upon cooling after heating for annealing), thereby causing deterioration in stretch flangeability.

P: 0.1 mass % or less

P represents an element that is unavoidably present as an impurity element, contributing to enhancement in strength due to solid solution reinforcement, however, P undergoes segregation at the grain boundary of an old austenite, rendering the grain boundary more brittle, thereby causing deterioration in stretch flangeability, a P content is therefore set to 0.1 mass % or less. The P content is preferably 0.05 mass % or less, and more preferably 0.03 mass or less.

S: less than 0.01 mass

S represents an element that is unavoidably present as an impurity element, forming MnS inclusion, which will act as a starting point of cracking at the time of hole expansion, thereby causing deterioration in stretch flangeability, so that an S content is set to less than 0.01 mass %. The S content is preferably less than 0.005 mass %. From the viewpoint as above, the S content desirably has a lower limit as low as possible, however, because it will be difficult to keep the S content at 0.002 mass % or less under industrial constraints as described under the heading of BACKGROUND TECHNOLOGY, the S content may be at 0.002 mass % plus.

N: 0.01 mass % or less

N as well represents an element that is unavoidably present as an impurity element, causing deterioration in elongation and stretch flangeability, due to strain ageing, so that an N content is preferably as low as possible to be set at 0.01 mass % or less.

Al: 0.01 to 1.00 mass %

Al is combined with N to form AlN, lessening solid solution N that contributes to occurrence of strain ageing, thereby preventing deterioration in stretch flangeability, and contributing to enhancement in strength by solid solution reinforcement. If an Al content is less than 0.01 mass %, residual solid solution N will remain in steel, so that strain ageing occurs, rendering it impossible to secure elongation and stretch flangeability. On the other hand, if the Al content is in excess of 1.00 mass %, this will block formation of austenite at the time of heating, so that it will be impossible to secure an area ratio of martensite, resulting in failure to secure stretch flangeability. Accordingly, the Al content is set to a range of 0.01 to 1.00 mass %.

A cold rolled sheet according to the present invention basically contains the components described as above, the remainder effectively being Fe and impurities. However, besides the above, components to be described later in the present specification, such as Mo, Cu, and so forth, may be added to the respective extents of scopes thereof within which effects of the invention are not impaired.

The present invention is described hereinafter by dividing it into four aspects thereof, that is, a first aspect of the invention (relating to a cold rolled steel sheet more enhanced in stretch flangeability than a conventional steel sheet), a second aspect of the invention (relating to a cold rolled steel sheet more enhanced in balance between elongation and stretch flangeability than a conventional steel sheet), and third and fourth aspects of the invention (relating to a cold rolled steel sheet enhanced in respect of any of yield stress, elongation and stretch flangeability), in connection with the respective aspects of the invention, a specific constitution being individually described hereunder.

[The First Aspect of the Invention]

First, a cold rolled steel sheet more enhanced in stretch flangeability than a conventional steel sheet (hereinafter referred to as a steel sheet according to the first aspect of the invention) is described.

[Structure of the Steel Sheet According to the First Aspect of the Invention]

The steel sheet according to the first aspect of the invention, described as above, is based on the single-phase structure of tempered martensite, or the dual-phase structure (the ferrite plus the tempered martensite) as is the case with Patent Documents 2, 3. However, the steel sheet according to the first aspect of the invention differs from the steel sheets according to Patent Documents 2, 3, respectively, in that the hardness of the tempered martensite, in particular, is controlled to 380 Hv or less while the number of coarse cementite particles precipitated in the tempered martensite, and the number of inclusions slender in shape, precipitated in the whole structure, are controlled.

<Tempered Martensite 380 Hv or Less in Hardness: an Area Ratio 50% or More (100% Included)>

The hardness of tempered martensite is controlled to enhance deformability of the tempered martensite, thereby checking stress concentration at the interface between ferrite and the tempered martensite, and preventing occurrence of a crack at the interface, so that stretch flangeability can be secured. Further, by forming a structure composed primarily of tempered martensite, high strength can be secured even if the hardness of the tempered martensite is lowered.

In order to effectively exhibit the function described as above, the hardness of tempered martensite is controlled to 380 Hv or less (preferably to 370 Hv or less, or more preferably to 350 Hv or less, and the tempered martensite has an area ratio at 50% or more, preferably at 60% or more, or more preferably at 70% or more (100% included). Further, the balance is ferrite.

<The Number of Cementite Particles 0.1 μm or More in Diameter of an Equivalent Circle: 2.3 Pieces or Less Per 1 $\mu m^2$ of Tempered Martensite>

By lessening the number of coarse cementite particles, each acting as a starting point of rupture at the time of elongated flange deformation, stretch flangeability can be improved. That is, stretch flangeability can be enhanced by controlling the number of the coarse cementite particles precipitated in martensite upon tempering.

In order to effectively exhibit the function described as above, the number of cementite particles 0.1 μm or more in diameter of an equivalent circle, contained per 1 $\mu m^2$ of tempered martensite, is controlled to 2.3 pieces or less, preferably 1.8 pieces or less, or more preferably 1.3 pieces or less.

<The Number of Inclusions 2.0 or More in Aspect Ratio: 200 Pieces or Less Per 1 $Mm^2$>

The inventor, et al. have carried out various studies by conducting a hole expanding test as to effects of inclusions present in a matrix structure (the whole structure) on stretch flangeability. As a result, the following knowledge has been acquired.

Upon examination of a state of a crack occurring in the vicinity of a rupture spot of a sample, it has turned out that a crack occurred mainly to inclusions slender in shape, and 2.0 or more in aspect ratio, and those inclusions slender in shape, and 2.0 or more in aspect ratio, were exerting control over the stretch flangeability.

The reason why the inclusions slender in shape, and 2.0 or more in aspect ratio, exert control over the stretch flangeability is presumably given as follows:

More specifically, in the case where a defect such as an inclusion is present in the matrix structure, stress σx occurring to the vicinity of the extremity of the defect can be expressed by expression (4):

$$\sigma x = K\sqrt{(2\pi x)} \quad (4)$$

$$K = M\sigma\sqrt{(\pi a)} \quad (5)$$

where σx: stress at a point away by a distance x from the extremity of a defect, x: a distance from the extremity of a defect, K: stress intensity factor, M: constant of proportionality, σ: stress accorded, and a: defect length.

Even in the case of inclusions (defects) identical in area to each other, as an aspect ratio of the inclusion increases, so does the major axis (defect length) a of the inclusion, and as is evident from the expression (5), the stress intensity factor K will be greater. As a result, as is evident from the expression (4), the stress σx occurring to the vicinity of the extremity of the inclusion (the defect), as well, will be greater, so that strain will turn out concentrated in the vicinity of the extremity of the inclusion (the defect). Further, if the aspect ratio of the inclusion (the defect) turns out 2.0 or more, the stress σx occurring to the vicinity of the extremity of the inclusion (the defect) will be excessively large, thereby causing strain concentration to exceed limitations, whereupon it is considered that cracks will be susceptible to occur.

Now, in order to effectively prevent occurrence of the crack, the number of the inclusions 2.0 or more in aspect ratio, present in the matrix structure (the whole structure), is controlled to 200 pieces or less per 1 $mm^2$, preferably 180 pieces or less, or more preferably 150 pieces or less.

There are described hereinafter methods for measuring hardness of tempered martensite, an area ratio thereof, a size of a cementite particle, the number of the cementite particles, an aspect ratio of an inclusion, and the number of the inclusions, respectively.

First, respective specimen steel sheets were subjected to mirror polishing to be corroded in a 3% niter solution to thereby expose a metallographic structure thereof, and subsequently, observation was made on images in five visual fields, respectively, picked up by a scanning electron microscope (SEM) of 20000×, the visual fields each covering a region of approximately 4 μm×3 μm, whereupon a part of the region, containing no cementite according to an image analysis, was defined as ferrite. Then a remaining part of the region was defined as martensite, and the area ratio of the martensite was worked out on the basis of area ratios of the respective parts of the region.

Then, in accordance with the testing method of JIS Z 2244, a measurement was made on Vickers hardness (98.07N) Hv of respective surfaces of the specimen steel sheets, and Vickers hardness was converted into martensite hardness HvM by use of expression (6)

$$HvM = (100 \times Hv - VF \times HvF)/VM \quad (6)$$

Figure 2:
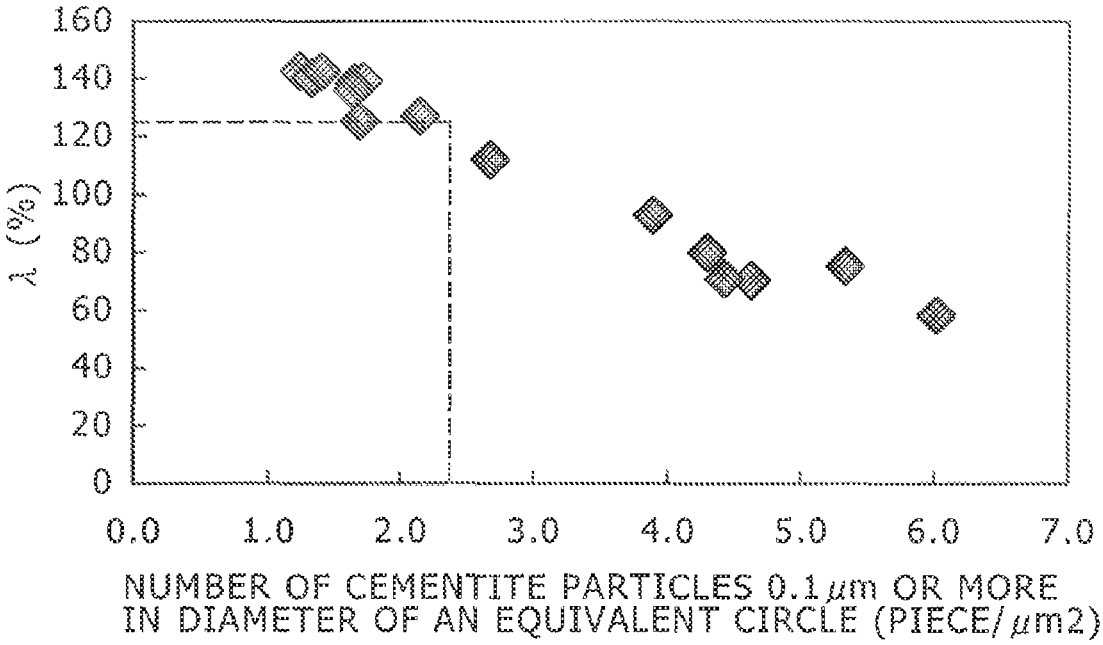
FIG. 2 is a graph showing a relationship between the number of cementite particles 0.1 μm or more in the diameter of an equivalent circle, and stretch flangeability (a hole expanding ratio) in a martensite structure.

HvF=102+209[% P]+27[% Si]+10[% Mn]+4[% Mo]−10[% Cr]+12[% Cu] (This is formulated by referring to degrees of effects (linear inclination) of respective alloying elements on variation in yield stress of low-ferrite steel on the basis of FIG. 2.1, p. 10, in "Designing and Theory, Iron and Steel Materials", by F. B. Pickering, and translated by Toshio Fujita, et al., published by Maruzen Company Ltd., Sep. 30, 1981. Further, it is assumed that other elements including Al, and N have no effect on the hardness of the ferrite.) Herein, HvF refers to ferrite hardness, VF a ferrite area ratio (%), VM a martensite area ratio, and [% X] content (%) of a component element X.

After the respective specimen steel sheets were subjected to the mirror polishing to be corroded in the 3% niter solution to thereby expose the metallographic structure thereof, observation was made on images in a visual field covering a region of 100 $\mu m^2$, picked up by a scanning electron microscope (SEM) of 10000× so as to enable the interior of martensite to be analyzed. Then, a white portion on the basis of contrast in the image was determined as cementite particles, and a marking is affixed thereto, whereupon the diameter of an equivalent circle was worked out from an area of each of the cementite particles with the marking, by running an image-analysis software program, and the number of the cementite particles present in a unit area, each thereof being of a predetermined size, was found.

Further, after the respective specimen steel sheets were subjected to the mirror polishing, observation was made on images in a visual field covering a region of 10000 $\mu m^2$, picked up by a scanning electron microscope (SEM) of 400×, and a black portion on the basis of contrast in the image was determined as inclusions, and a marking is affixed thereto, whereupon the maximum diameter and the minimum diameter of each of the inclusions with the marking were found by running the image-analysis software program, and a ratio thereof (the maximum diameter/the minimum diameter) was determined as an aspect ratio while the number of the inclusions 2.0 or more, in aspect ratio, being present in a unit area, was found.

<Component Composition of the Steel Sheet According to the First Aspect of the Invention>

The steel sheet according to the first aspect of the invention has the fundamental component composition described in the foregoing, however, the Si content thereof is preferably in a range of 0.5 to 3.0 mass % for the following reason.

More specifically, Si has an effect of suppressing coarsening of cementite particles at the time of tempering besides an effect previously described to thereby enhance the stretch flangeability by preventing generation of coarse cementite particles. If the Si content is less than 0.5 mass %, this will coarsen cementite particles during tempering, resulting in an increase in the number of cementite particles 0.1 μm or more in the diameter of an equivalent circle, so that it is not possible to exhibit considerably excellent stretch flangeability as high as 125% or more. On the other hand, if the Si content is in excess of 3.0 mass %, this will block formation of austenite at the time of heating, so that it is impossible to secure an area ratio of martensite, and stretch flangeability cannot be secured either.

The Si content of the steel sheet according to the first aspect of the invention is preferably in a range of 0.7 to 2.5 mass %, or more preferably in a range of 1.0 to 2.0 mass %.

Mn has an effect of suppressing coarsening of cementite particles at the time of tempering as is the case with Si. Accordingly, Mn also has effects of not only increasing the number of suitably fine cementite particles while preventing generation of coarse cementite particles to thereby contribute to striking a good balance between elongation and stretch flangeability, but also securing hardenability.

The Mn content of the steel sheet according to the first aspect of the invention is preferably in a range of 0.60 to 3.0 mass %, or more preferably in a range of 1.30 to 2.5 mass %.

There is described hereinafter a preferable manufacturing method for obtaining the steel sheet according to the first aspect of the invention.

[Preferable Method for Manufacturing the Steel Sheet According to the First Aspect of the Invention]

In order to manufacture the cold rolled steel sheet according to the first aspect of the invention, a steel having the component composition described in the foregoing is first produced in hot metal state to be turned into a slab by casting into an ingot, or continuous casting before being subjected to hot rolling. In hot rolling, the termination temperature of finish rolling is set to an $Ar_3$ point or higher, and after cooling as appropriate, a workpiece is rolled up at a temperature in a range of 450 to 700°. After completion of the hot rolling, pickling is carried out to be followed by cold rolling, and in the cold rolling, a reduction ratio on the order of 30% or higher is preferably adopted.

Further, the cold rolling is followed by annealing to be repeated twice, and tempering is further carried out.

[First Annealing Conditions]

During a first annealing, a workpiece is heated to an annealing heating-temperature: from 1100 to 1200° C., to be held for annealing retention time: from in excess of 10 s to 3600 s or less, before being cooled down to 200° C. or lower. There is no particular limitation to a cooling rate, and cooling means are optional.

<Heating to the Annealing Heating-Temperature: from 1100 to 1200° C., The Annealing Retention Time: from in Excess of 10 s to 3600 s or Less>

This is a condition under which an inclusion (MnS, in particular) expanded by cold rolling is caused to undergo spheroidizing by heating for annealing. If the annealing heating-temperature is below 1100° C., or the annealing retention time is less than 10 s, an inclusion will undergo an insufficient change in form, so that it will be impossible to sufficiently lessen the number of the inclusions 2.0 or less in aspect ratio, present in the whole structure. On the other hand, if the annealing heating-temperature is higher than 1200° C., or the annealing retention time is more than 3600 s, this will render both occurrence of oxidized scales on the surface of the steel sheet, and decarburization on the surface of the steel sheet to be conspicuous in an industrial furnace where heating is applied in an oxidizing atmosphere, and such a condition is therefore undesirable.

[Second Annealing Condition]

During a second annealing, a workpiece is heated to an annealing heating-temperature: $[(Ac_1+Ac_3)/2]$ to 1000° C. to be held for annealing retention time: 3600 s or less, and subsequently, is preferably quenched from the annealing heating-temperature directly to a temperature at an Ms point or lower at a cooling rate of 50° C./s or more. Otherwise, the workpiece is preferably slow-cooled from the annealing heating-temperature to a temperature lower than the annealing heating-temperature, and at 600° C. or higher (a first cooling completion temperature) at a cooling rate of 1° C./s or more (a first cooling rate) before being preferably quenched to a temperature at the Ms point or lower (a second cooling completion temperature) at a cooling rate of 50° C./s or less (a second cooling rate).

<Annealing Heating-Temperature: $[(Ac_1+Ac_3)/2]$ to 1000° C., Annealing Retention Time: 3600 s or Less>

This is a condition under which the workpiece is sufficiently transformed in phase to austenite at the time of annealing heating to secure an area ratio 50% or more for martensite that is formed by transformation from the austenite at the time of subsequent cooling.

If the annealing heating-temperature is below $[(Ac_1+Ac_3)/2]$° C., an amount of austenite transformed at the time of annealing heating is insufficient, and an amount of martensite formed by transformation from the austenite at the time of subsequent cooling will decrease, so that the area ratio 50% or more of martensite cannot be secured. On the other hand, if the annealing heating-temperature exceeds 1000° C., this will coarsen an austenite structure to thereby cause deterioration not only in bendability and toughness of the steel sheet but also in annealing facilities, and such a condition is therefore undesirable.

Further, if the annealing retention time exceeds 3600 s, this will render productivity extremely poorer, and such a condition is therefore undesirable.

<Quenching to a Temperature at an Ms Point or Lower at a Cooling Rate of 50° C./s or More>

This is a condition under which formation of ferrite and bainite structures from austenite during cooling is suppressed to thereby obtain martensite.

If quenching is terminated at a temperature higher than the Ms point, or the cooling rate is less than 50° C./s, this will cause bainite to be formed, so that the strength of the steel sheet cannot be secured.

<Slow-Cooling to a Temperature Lower than the Annealing Heating-Temperature, and at 600° C. or Higher at a Cooling Rate of 1° C./s or More>

By so doing, a ferrite structure with an area ratio less than 50% is formed, thereby rendering it possible to aim at improvement in elongation while securing stretch flangeability.

At a temperature lower than 600° C., or at a cooling rate less than 1° C./s, ferrite is excessively formed, resulting in an insufficient area ratio of martensite, so that it will be impossible to secure both strength and stretch flangeability.

[Tempering Condition]

As a tempering condition, for an interval from a temperature after the annealing cooling to a first-stage tempering heating-temperature: 325 to 375° C., heating is applied at an average heating rate 5° C./s or more between 100 to 325° C., which condition is held for first-stage tempering retention time: 50 s or more, followed by further heating up to a second-stage tempering heating-temperature T: 400° C. or higher, being held under a condition that second-stage tempering retention time t(s) is expressed by $Pt=(T+273)\cdot[\log(t)+17]>13600$, and $Pg=\exp[-9649/(T+273)]\times t<0.9\times10^{-3}$, and it need only be sufficient to apply cooling thereafter. Further, in the case of changing the temperature T during the second-stage tempering retention time, use can be made of expression (7) given hereunder.

[Formula 1]

$$Pg = \int_0^t \exp\left(-\frac{9649}{(T(t)+273)}\right)\cdot dt \qquad \text{expression (7)}$$

By holding the workpiece in the neighborhood of 350° C. in a temperature region where cementite is precipitated from martensite at the highest rate, cementite particles are caused to be uniformly precipitated in a martensite structure, and subsequently, by heating the workpiece to a higher temperature region to be held therein, it is possible to cause the cementite particles to grow to a suitable size.

<Heating at an Average Heating Rate 5° C./s or More Between 100 to 325° C. Up to a First-Stage Tempering Heating-Temperature: 325 to 375° C.>

If the first-stage tempering heating-temperature is lower than 325° C., or exceeds 375° C., or the average heating rate is less than 5° C./s, this will cause precipitation of the cementite particles to unevenly occur inside the martensite, so that the proportion of coarse cementite particles will be higher due to growth thereof during the second stage heating, and holding, taking place thereafter, rendering it impossible to obtain stretch flangeability.

<Heating Up to a Second-Stage Tempering Heating-Temperature T: 400° C. or Higher, being Held Under a Condition that Second-Stage Tempering Retention Time t (s) is Expressed by $Pt=(T+273)\cdot[\log(t)+17]>13600$, and $Pg=\exp[-9649/(T+273)]\times t<0.9\times10^{-3}$>

Herein, $Pt=(T+273)\cdot[\log(t)+17]$ is a parameter for stipulating hardness of tempered martensite, described in "Iron and Steel materials Course•Current Metallurgy, Materials Chapter 4", compiled by the Metallographic Society of Japan, p. 50. Further, $Pg=\exp[-9649/(T+273)]\times t$ is a parameter for stipulating a size of a cementite particle as a precipitate, obtained by setting and simplifying the parameter on the basis of a precipitate grain growth model, described in expressions (4, 18), p. 106, "Material Metallography", by Koichi Sugimoto, et al., published by Asakura Publishing Co., Ltd.

If the second-stage tempering heating-temperature T is lower than 400° C., the second-stage tempering retention time t necessary for causing the cementite particle to grow to a satisfactory size will be excessively long.

If $Pt=(T+273)\cdot[\log(t)+17]\leqq13600$, the hardness of martensite will not sufficiently decrease, so that stretch flangeability cannot be obtained.

If $Pg=\exp[-9649/(T+273)]\times t\geqq0.9\times10^{-3}$, the cementite particle will be coarsened, and the number of cementite particles 0.1 μm or more in the diameter of an equivalent circle will excessively increase, so that stretch flangeability cannot be obtained in this case either.

[The Second Aspect of the Invention]

Next, the cold rolled steel sheet more enhanced in balance between elongation and stretch flangeability than a conventional steel sheet (hereinafter referred to as a steel sheet according to the second aspect of the invention) is described.

[Structure of the Steel Sheet According to the Second Aspect of The Invention]

As previously described, the steel sheet according to the second aspect of the invention is based on the dual-phase structure (the ferrite plus the tempered martensite), as is the case with Patent Documents 2, 3, respectively. However, the steel sheet according to the second aspect of the invention differs from the steel sheets according to Patent Documents 2, 3, respectively, in that the hardness of the tempered martensite, in particular, is controlled to a range of 330 to 450 Hv, and orientation distribution of angles formed between the longitudinal direction of a ferrite grain, and a C-direction (a direction at right angles to a rolling direction) is under isotropic control.

<The Tempered Martensite: Hardness 330 Hv or More, and 450 Hv or Less>

While the hardness of the tempered martensite is kept at not lower than a predetermined value to thereby secure tensile strength, the hardness is controlled to not higher than a predetermined value to thereby enhance deformability of the tempered martensite. By so doing, stress concentration at the interface between ferrite and the tempered martensite is checked, and occurrence of a crack at the interface is prevented, thereby securing stretch flangeability.

In order to effectively exhibit the function described as above, the hardness of tempered martensite is 330 Hv or more, and 450 Hv or less (more preferably 430 Hv or less)

<Tempered Martensite: an Area Ratio 50% or More, and 70% or Less>

By forming a structure composed primarily of tempered martensite, high tensile strength can be secured although the hardness of tempered martensite is lowered. By securing an area ratio of ferrite to some extent at the same time to thereby cause strain to be shared between ferrite and martensite, elongation is secured.

In order to effectively exhibit the function described as above, tempered martensite has an area ratio 50% or more, and 70% or less (more preferably 60% or less). Further, the balance is ferrite.

<Ferrite: the Maximum Grain Size 12 μm or Less, in Terms of the Diameter of an Equivalent Circle>

Even if ferrite ranging from 30 to 50% in area ratio is introduced in a matrix structure, stress concentration at the interface between ferrite and martensite is checked by decreasing a ferrite grain size, and occurrence of a crack at the interface is prevented, thereby securing stretch flangeability.

In order to effectively exhibit the function described as above, the maximum grain size of ferrite is controlled to 12 μm or less (more preferably 10 μm or less) in terms of the diameter of an equivalent circle.

<Frequency Distribution of an Angle Formed Between the C-Direction and the Longitudinal Direction of a Ferrite Grain, in Every 10-Degrees Step: the Maximum Value at 18% or Less, the Minimum Value at 6% or More>

In the dual-phase structure comprised of ferrite and martensite, the orientation distribution of the longitudinal directions of the ferrite grain, in relation to the C-direction, is caused to approximate isotropy, structure uniformity of the dual-phase structure is enhanced to thereby secure stretch flangeability.

Furthermore, function effects on tensile strength and elongation are as follows.

When the interface between ferrite and martensite is in parallel with a direction of pull, a ferrite phase and a martensite phase each undergo deformation with a equal strain, so that the tensile strength of the martensite phase, corresponding to its structure fraction, will be reflected to thereby secure the tensile strength of the dual-phase structure, however, elongation of the dual-phase structure is governed by the martensite phase.

On the other hand, when the interface between ferrite and martensite is at right angles to the direction of pull, the ferrite phase and the martensite phase each undergo deformation with a equal strain, so that the elongation of the ferrite phase, corresponding to its structure fraction, will be reflected to thereby enhance the elongation of the dual-phase structure, however, the tensile strength of the dual-phase structure is governed by the ferrite phase.

With the dual-phase structure comprised of ferrite and martensite, to cause the orientation distribution of the longitudinal directions of the ferrite grain, in relation to the C-direction, to approximate isotropy means that the orientation distribution in good balance is introduced such that a component of the direction of the interface between ferrite and martensite, in parallel with the direction of pull, is substantially equal to a component of the direction of the interface between ferrite and martensite, at right angles to the direction of pull. As a result, it is possible to enhance elongation while securing tensile strength.

In order to effectively exhibit the function described as above, the frequency distribution of the angle formed between the C-direction and the longitudinal direction of a ferrite grain, in every 10-degrees step, indicates the maximum value at 18% or less, and the minimum value at 6% or more (more preferably the maximum value at 16% or less, and the minimum value at 7% or more).

In the case of departure from ranges described as above, stain is not appropriately distributed between ferrite and martensite, so that it will be impossible to aim at striking a good balance between tensile strength 980 MPa or higher, and elongation 13% or more, or since structure uniformity will be insufficient, it will be impossible to secure stretch flangeability.

There are described hereinafter methods for measuring hardness of tempered martensite, an area ratio thereof, the maximum diameter of a ferrite grain (the diameter of an equivalent circle), and orientation of ferrite grains (distribution of angles formed between the C-direction and the longitudinal direction of a ferrite grain), respectively.

First, respective specimen steel sheets were first adjusted so as to be able to observe a surface where a rolling direction corresponds to the normal direction to be subsequently subjected to mirror polishing, and corroded in a 3% niter solution to thereby expose a metallographic structure thereof before observation was made on three visual fields, respectively, by use of a scanning electron microscope (SEM) of 1000×. Then, a region in an SEM image, containing white grained contrast, was determined as martensite, and a proportion of the region to the whole image was measured by image analysis to be defined as an area ratio of the martensite.

Then, in accordance with the testing method of JIS Z 2244, a measurement was made on Vickers hardness (98.07N) Hv of the respective surfaces of the specimen steel sheets, and Vickers hardness was converted into martensite hardness HvM by use of expression (6)

$$HvM=(100\times Hv-VF\times HvF)/VM \quad (6)$$

The above is formulated by referring to degrees of effects (linear inclination) of respective alloying elements on variation in yield stress of low-ferrite steel on the basis of HvF=102+209[% P]+27[% Si]+10[% Mn]+4[% Mo]−10[% Cr]+12[% Cu], in "Designing and Theory for Iron and Steel Materials", by F. B. Pickering and translated by Toshio Fujita, et al., published by Maruzen Company Ltd., Sep. 30, 1981, FIG. 2.1, p. 10. Further, it is assumed that other elements including Al, and N have no effect on the hardness of the ferrite. Herein, HvF refers to ferrite hardness, VF: a ferrite area ratio (%), VM: a martensite area ratio, and (% X): content (mass %) of a component element X.

As for the maximum diameter of a ferrite grain (the diameter of an equivalent circle), a measurement was made on areas of individual particles by image analysis to be followed by conversion into the diameter of an equivalent circle by use of expression (8), thereby finding the maximum value thereof.

$$[\text{diameter of an equivalent circle}]=2\times(A/\pi)^{0.5} \quad (8)$$

where A: an area of a particle.

As for the orientation of ferrite grains (distribution of angles formed between the C-direction and the longitudinal direction of a ferrite grain), frequency distribution in every 10-degrees step of the angle was found by use a parameter called [angle], indicating angles formed between the C-direction and the longitudinal directions of respective ferrite grains, from image analysis using image analysis software (Image ProPlus produced by Media Cybernetics), thereby finding the maximum value and the minimum value in the frequency distribution.

<Component Composition of the Steel Sheet According to the Second Aspect of the Invention>

The steel sheet according to the second aspect of the invention has the fundamental component composition according to the present invention. However, Mn content thereof is preferably in a range of 0.5 to 5.0 mass %. The content thereof is more preferably in a range of 0.7 to 4.0 mass %, or most preferably in a range of 1.0 to 3.0 mass %.

The steel sheet according to the second aspect of the invention contains Si also falling within the scope of the fundamental component composition according to the present invention. However, the Si content of the steel sheet according to the second aspect of the invention is preferably in a range of 0.3 to 2.5 mass %, or more preferably in a range of 0.5 to 2.0 mass %.

[Preferable Method for Manufacturing the Steel Sheet According to the Second Aspect of the Invention]

Next, there is described hereinafter a preferable manufacturing method for obtaining the steel sheet according to the second aspect of the invention.

In order to manufacture the cold rolled steel sheet according to the second aspect of the invention, a steel having the component composition described in the foregoing is first produced in hot metal state to be turned into a slab by casting into an ingot, or continuous casting before being subjected to hot rolling. Under hot rolling conditions, the termination temperature of finish rolling is set to an $Ar_3$ point or higher, and after cooling as appropriate, a workpiece is rolled up at a temperature in a range of 450 to 700°. After completion of the hot rolling, pickling is carried out to be followed by cold rolling, and in the cold rolling, a reduction ratio on the order of 30% or higher is preferably adopted.

Further, the cold rolling is followed by annealing to be repeated twice, and tempering is further carried out.

[First Annealing Conditions]

Under first annealing conditions, a workpiece is heated to an annealing heating-temperature: $Ac_3$ to 1000° C., to be held for annealing retention time: 3600 s or less, before being quenched from the annealing heating-temperature directly to a temperature at an Ms point or lower at a cooling rate of 50° C./s or higher.

<The Annealing Heating-Temperature: $Ac_3$ to 1000° C., the Annealing Retention Time: 3600 s or Less>

By so doing, the workpiece is sufficiently transformed in phase to austenite at the time of annealing heating to secure an area ratio as high as possible for martensite that is formed by transformation from the austenite at the time of subsequent cooling.

If the annealing heating-temperature is lower than the $Ac_3$° C., an amount of austenite transformed at the time of annealing heating is insufficient, and an amount of martensite formed by transformation from the austenite at the time of subsequent cooling will decrease, so that a satisfactory area ratio cannot be secured. On the other hand, if the annealing heating-temperature exceeds 1000° C., this will coarsen an austenite structure to thereby cause coarsening of a ferrite grain size after application of a second annealing, and tempering, so that it will be impossible to obtain stretch flangeability while deterioration in annealing facilities will result, such a condition being therefore undesirable.

Further, if the annealing retention time exceeds 3600 s, this will render productivity extremely poorer, and therefore, such a condition is undesirable.

<Quenching to a Temperature at an Ms Point or Lower at a Cooling Rate of 50° C./s or More>

By so doing, formation of ferrite and bainite structures from austenite during cooling is suppressed to thereby obtain martensite.

If quenching is terminated at a temperature higher than the Ms point, or the cooling rate is less than 50° C./s, this will cause bainite to be formed, so that ferrite grain size is coarsened in a final structure, and stretch flangeability cannot be obtained.

As a result of the first annealing, micronization of the structure can be achieved, and inheritance of a structure as-rolled can be checked. Without the first annealing, the structure as-rolled would be inherited, and crystal grains would be arranged in parallel with the C-direction, so that strain would not be satisfactorily distributed between ferrite, and martensite, thereby rendering it impossible to secure elongation. Further, the orientation distribution of the longitudinal directions of the ferrite grain, in relation to the C-direction, would be insufficient in isotropy, thereby rendering it impossible to secure stretch flangeability.

[Second Annealing Conditions]

Under a second annealing, a workpiece is heated to an annealing heating-temperature: $[(Ac_1+Ac_3)/2]$ or higher to $Ac_3$ or lower at a warming rate of 15° C./s or more to be held for annealing retention time: 600 s or less, and subsequently, is preferably quenched from the annealing heating-temperature directly to a temperature at an Ms point or lower at a cooling rate of 50° C./s or more.

<A Rate of Temperature Rise: 15° C./s or More>

A steel stock manufactured on an industrial scale contains microsegregation of an Mn-compound formed in a melting stage. The microsegregation of the Mn-compound (hereinafter referred to as "Mn segregation") is compressed in the direction of a sheet thickness, and is stretched in both an L-direction (the rolling direction), and the C-direction (a direction perpendicular to both the rolling direction and the direction of the sheet thickness). For this reason, when a steel sheet structure in cross-section is observed, the Mn segregation appears in a form in as-stretched state. The Mn segregation is not eliminated in an industrial process. Accordingly, when heat treatment is applied to a cold rolled steel stock, the Mn segregation stretched in both the L-direction, and the C-direction is present in layers. Since Mn is an element for stabilizing martensite, transformation from ferrite to martensite is promoted in a region high in the Mn content at the time of heating while transformation from martensite to ferrite is suppressed at the time of cooling. For this reason, with a steel (DP steel) of the dual-phase structure where the Mn segregation is present, martensite is formed along an Mn segregation layer, and ferrite is formed along an Mn negative-segregation layer, respectively, in a form as-stretched in the C-direction unless a transformation behavior is satisfactorily controlled.

In a state where the Mn segregation is present, in order to cause the direction of the major axis of a ferrite grain to remain random without being converged in the C-direction, a homogeneous martensite structure obtained by heat treatment at the first annealing is turned into a superheated martensite by rapid heating at the rate of temperature rise: 15° C./s or more, thereby causing a large inverse-transformation drive force to be generated. As a result, inverse-transformation uniformly occurs regardless of the presence or absence of the Mn segregation, so that a structure obtained by cooling applied subsequently will be turned uniform, and the direction of the major axis (the longitudinal direction) of the ferrite grain comes to be oriented in a random direction.

If the rate of temperature rise is less than 15° C./s, this will affect nucleation, and nucleus growth will affect the Mn segregation, so that such a condition is not desirable for satisfactory isotropic orientation distribution of the longitudinal directions of the ferrite grain.

<Annealing Heating-Temperature: $[(Ac_1+Ac_3)/2]$ or Higher and Lower than $Ac_3$, Annealing Retention Time: 600 s or Less>

By so doing, the workpiece is transformed in phase to a suitable amount of austenite at the time of the second annealing heating to thereby enable martensite that is formed by transformation from the austenite at the time of subsequent cooling to secure an area ratio 50% or more, and 70% or less.

If the annealing heating-temperature is lower than $(Ac_1+Ac_3)/2$, an amount of austenite transformed at the time of the second annealing heating is insufficient, and an amount of martensite formed by transformation from the austenite at the time of subsequent cooling will decrease, so that the area ratio 50% or more of martensite cannot be secured. On the other hand, if the annealing heating-temperature exceeds $Ac_3$, this will cause an amount of austenite transformed to be excessive, and an area ratio of ferrite as the balance will decrease, so that it is impossible to secure sufficient elongation. The upper limit of the annealing heating-temperature is more preferably $(0.3Ac_1+0.7Ac_3)$.

If the annealing retention time exceeds 600 s, a structure that has turned isotropic by raid heating will be stretched in the C-direction owing to the effect of the Mn segregation, so that isotropy of the longitudinal directions of the ferrite grain, in relation to the C-direction, undergoes deterioration, thereby causing deterioration in elongation and stretch flangeability.

<Quenching to the Temperature at the Ms Point or Lower at the Cooling Rate of 50° C./s or More>

As described in connection with the first annealing conditions, by so doing, formation of ferrite and bainite structures from austenite during cooling is suppressed to thereby obtain martensite.

If quenching is terminated at a temperature higher than the Ms point, or the cooling rate is less than 50° C./s, this will cause bainite to be formed, so it will be impossible to secure the tensile strength of the steel sheet.

<Tempering Conditions>

Martensite in as-annealed state being very hard, stretch flangeability undergoes deterioration. In order to secure stretch flangeability while securing tensile strength, it is necessary to keep hardness of the tempered martensite in a range of 330 to 450 Hv. For that purpose, there is the need for applying tempering (a reheating treatment) whereby a workpiece is held in a temperature range of 300 to 550° C. for 60 s or more, and 1200 s or less.

If a retained temperature in this tempering process is lower than 300° C., softening of martensite will be insufficient, thereby causing deterioration in stretch flangeability. On the other hand, if the retained temperature is higher than 550° C., this will cause the hardness of the tempered martensite to be excessively lowered, so that tensile strength cannot be obtained.

Further, if retention time in the tempering process is shorter than 60 s, softening of the martensite will be insufficient, so that elongation as well as stretch flangeability of the steel sheet will undergo deterioration. On the other hand, if the retention time is longer than 1200 s, this will cause the martensite to be excessively softened, so that it will be difficult to secure tensile strength. The retention time is preferably 90 s or more, and 900 s or less, or more preferably 120 s or more, and 600 s or less.

[The Third and Fourth Aspects of the Invention]

Now, there are described hereinafter steel sheets that are enhanced in respect of any of yield stress, elongation and stretch flangeability, respectively (hereinafter referred to as a steel sheet according to the third aspect of the invention, or as a steel sheet according to the fourth aspect of the invention).

[Structure of the Steel Sheet According to the Third Aspect of the Invention]

As previously described, the steel sheet according to the aspect of the invention is based on the single-phase structure of tempered martensite, or the dual-phase structure (the ferrite plus the tempered martensite, as is the case with Patent Documents 2, 3, respectively). However, the steel sheet according to the third aspect of the invention differs from the steel sheets according to Patent Documents 2, 3, respectively, in that the hardness of the tempered martensite, in particular, is controlled to 380 Hv or less, and dislocation density in the whole structure is controlled.

<The Tempered Martensite 380 Hv or Less in Hardness: an Area Ratio 50% or More (100% Included)>

The hardness of the tempered martensite is controlled to enhance deformability of the tempered martensite, thereby checking stress concentration at the interface between ferrite and the tempered martensite, and preventing occurrence of a crack at the interface, so that stretch flangeability can be secured. Further, by forming a structure composed primarily of tempered martensite, high yield strength can be secured even if the hardness of the tempered martensite is lowered.

In order to effectively exhibit the function described as above, the hardness of the tempered martensite is controlled to 380 Hv or less (preferably to 370 Hv or less, or more preferably to 350 Hv or less, and the tempered martensite has an area ratio at 50% or more, preferably at 60% or more, or more preferably at 70% or more (100% included). Further, the balance is ferrite.

<Dislocation Density in the Whole Structure: $1\times10^{15}$ to $4\times10^{15}$ m⁻>

The inventor, et al. have found out that in the case of a C—Si—Mn base low-alloy steel having the component composition described as above, yield strength of a structure composed primarily of tempered martensite having a tempering temperature exceeding 400° C. is heavily dependent on dislocation reinforcement, in particular, among four reinforcing mechanisms (solid solution reinforcement, precipitation reinforcement, micronization reinforcement, and dislocation reinforcement). Further, it has turned out that in order to secure yield strength 900 MPa or higher, it is necessary to secure dislocation density in the whole structure: $1\times10^{15}$ $m^{-2}$.

Meanwhile, since elongation has strong negative correlation with dislocation density in the initial stage of deformation, it has turned out that there is the need for controlling dislocation density to $4\times10^{15}$ $m^{-2}$ in order to secure elongation at 10% or more.

Accordingly, the dislocation density in the whole structure is set to from $1\times10^{15}$ to $4\times10^{15}$ $m^{-2}$.

<[Si Equivalent]≧$4.0-5.3\times10^{-8}\sqrt{[\text{Dislocation Density}]}$>

As described above, to secure elongation at 10% or more, there is the upper limit to the dislocation density that can be introduced in the whole structure. Accordingly, the inventor, et al. have carried out further studies, and have found out as a result that it is necessary to make good use of solid solution reinforcement contributing to the dislocation density after dislocation reinforcement in order to obtain yield strength 900 MPa or higher with certainty.

First, Si equivalent shown by expression (1) has been introduced as index indicating a solid solution amount necessary for obtaining yield strength at 900 MPa or higher with certainty. The Si equivalent is obtained by formulation after converting solid solution reinforcing functions of respective elements other than Si (refer to "Designing and Theory, Iron and Steel Materials", by F. B. Pickering, translated by Toshio Fujita, et al., published by Maruzen Company Ltd., Sep. 30, 1981, p. 8) into Si concentration on the basis of Si as a representative element exhibiting a solid solution reinforcing function.

$$[\text{Si equivalent}]=[\%\ \text{Si}]+0.36[\%\ \text{Mn}]+7.56[\%\ \text{P}]+0.15[\%\ \text{Mo}]+0.36[\%\ \text{Cr}]+0.43[\%\ \text{Cu}] \quad (1)$$

Next, an increment $\Delta\sigma$ of yield strength due to dislocation reinforcement is expressed by $\Delta\sigma\propto\sqrt{\rho}$ as a function of dislocation density $\rho$ on the basis of Bailey-Hirsh formula (refer to "Method for Evaluating Dislocation Density by utilizing X-ray Diffraction", by Koichi Nakajima, et al., Materials, and Process, Japan Institute of Iron and Steel, 2004, Vol. 17, No. 3, pp. 396 to 399). Further, as a result of verification on quantitative relation between an incremental effect of yield strength due to the solid solution reinforcement, and an incremental effect of yield strength due to the dislocation reinforcement through experiments, it has turned out that yield strength 900 MPa or higher can be obtained with certainty if Si equivalent satisfies expression (2):

$$[\text{Si equivalent}]\geqq 4.6-5.3\times10^{-8}\sqrt{[\text{dislocation density}]} \quad \text{expression (2)}$$

There are described hereinafter methods for measuring hardness of tempered martensite, an area ratio thereof, and dislocation density thereof, respectively.

In order to find an area ratio of martensite, respective specimen steel sheets were first subjected to mirror polishing to be corroded in a 3% niter solution to thereby expose a metallographic structure thereof, and subsequently, observation was made on images in five visual fields, respectively, picked up by a scanning electron microscope (SEM) of 20000×, the visual fields each covering a region of approximately 4 μm×3 μm, whereupon a part of the region, containing no cementite according to an image analysis, was defined as ferrite. Then a remaining part of the region was defined as martensite, and the area ratio of the martensite was worked out on the basis of area ratios of the respective parts of the region.

Then, as for hardness of tempered martensite, a measurement in accordance with the testing method of JIS Z 2244 was made on Vickers hardness (98.07N) Hv of respective surfaces of the specimen steel sheets, and Vickers hardness was converted into martensite hardness HvM by use of the expression (6).

$$HvM=(100\times Hv-VF\times HvF)/VM \quad (6)$$

where HvF=102+209[% P]+27[% Si]+10[% Mn]+4[% Mo]−10[% Cr]+12[% Cu] (This is formulated by referring to degrees of effects (linear inclination) of respective alloying elements on variation in yield stress of low-ferrite steel on the basis of FIG. 2.1, p. 10, in "Designing and Theory, Iron and Steel Materials", by F. B. Pickering, and translated by Toshio Fujita, et al., published by Maruzen Company Ltd., Sep. 30, 1981. Further, it is assumed that other elements including Al, and N have no effect on the hardness of the ferrite.)

Herein, HvF refers to ferrite hardness, VF a ferrite area ratio (%), VM a martensite area ratio, and (% X) content (mass %) of a component element X.

In order to work out dislocation density, a specimen was adjusted so as to enable a position at ¼ in depth of a sheet thickness to be measured, and subsequently, the specimen was coated with Si powders for use as a reference specimen to be subjected to an X-ray diffraction system (RAD-RU300 manufactured by Rigaku Denki K. K.), thereby having extracted an X-ray diffraction profile. Then, dislocation density was worked out according to an analysis method proposed by Nakajima, et al. on the basis of the X-ray diffraction profile (refer to "Method for Evaluating Dislocation Density by utilizing X-ray Diffraction", by Koichi Nakajima, et al., Materials, and Process, Japan Institute of Iron and Steel, 2004, Vol. 17, No. 3, pp. 396 to 399)

The steel sheet according to the third aspect of the invention has the fundamental component composition described in the foregoing, however, the Si content thereof is preferably in a range of 0.1 to 3.0 mass %. The Si content is more preferably in a range of 0.30 to 2.5 mass %, most preferably in a range of 0.50 to 2.0 mass %.

Mn as well is within the range according to the fundamental component composition of the steel sheet according to the present invention, and the steel sheet according to the third aspect of the invention has a preferable Mn content in a range of 0.30 to 4.0 mass %, or a more preferable Mn content in a range of 0.50 to 3.0 mass %.

[Preferable Method for Manufacturing the Steel Sheet According to The Third Aspect of the Invention]

Next, there is described hereinafter a preferable manufacturing method for obtaining the steel sheet according to the third aspect of the invention.

In order to manufacture the cold rolled steel sheet according to the third aspect of the invention, a steel having the component composition described in the foregoing is first produced in hot metal state to be turned into a slab by casting into an ingot, or continuous casting before being subjected to hot rolling. Under hot rolling conditions, the termination temperature of finish rolling is set to an $Ar_3$ point or higher, and after cooling as appropriate, a workpiece is rolled up at a temperature in a range of 450 to 700° C. After completion of the hot rolling, pickling is carried out to be followed by cold rolling, and in the cold rolling, a reduction ratio on the order of 30% or higher is preferably adopted.

Further, the cold rolling is followed by annealing and tempering is further carried out.

[Annealing Conditions]

Under annealing conditions, a workpiece is heated to an annealing heating-temperature: $[(Ac_1+Ac_3)/2]$ to 1000° C. to be held for annealing retention time: 3600 s or less, and subsequently, is preferably quenched from the annealing heating-temperature directly to a temperature at an Ms point or lower at a cooling rate of 50° C./s or more. Otherwise, the workpiece is preferably slow-cooled from the annealing heating-temperature to a temperature lower than the annealing heating-temperature, and at 600° C. or higher (a first cooling completion temperature) at a cooling rate of 1° C./s or more (a first cooling rate), before being preferably quenched to a temperature at the Ms point or lower (a second cooling completion temperature) at a cooling rate of 50° C./s or less (a second cooling rate).

<Annealing Heating-Temperature: $[(Ac_1+Ac_3)/2]$ to 1000° C., Annealing Retention Time: 3600 s or Less>

This is a condition under which the workpiece is sufficiently transformed in phase to austenite at the time of annealing heating to secure an area ratio 50% or more for martensite that is formed by transformation from the austenite at the time of subsequent cooling. If the annealing heating-temperature is lower than $[(Ac_1+Ac_3)/2]$° C., an amount of austenite transformed at the time of annealing heating is insufficient, and an amount of martensite formed by transformation from the austenite at the time of subsequent cooling will decrease, so that the area ratio 50% or more of martensite cannot be secured. On the other hand, if the annealing heating-temperature exceeds 1000° C., this will coarsen an austenite structure to thereby cause deterioration not only in bendability and toughness of the steel sheet but also in annealing facilities, and such a condition is therefore undesirable.

Further, if the annealing retention time exceeds 3600 s, this will render productivity extremely poorer, and such a condition is therefore undesirable.

<Quenching to a Temperature at an Ms Point or Lower at a Cooling Rate of 50° C./s or More>

This is a condition under which formation of ferrite and bainite structures from austenite during cooling is suppressed to thereby enable martensite to be obtained.

If quenching is terminated at a temperature higher than the Ms point, or the cooling rate is less than 50° C./s, this will cause bainite to be formed, so that the strength of the steel sheet cannot be secured.

<Slow-Cooling to a Temperature Lower than the Annealing Heating-Temperature, And at 600° C. or Higher, at a Cooling Rate of 1° C./s or More>

By so doing, a ferrite structure with an area ratio less than 50% is formed, thereby rendering it possible to aim at improvement in elongation while securing stretch flangeability.

At a temperature lower than 600° C., or at a cooling rate less than 1° C./s, ferrite is excessively formed, resulting in an insufficient area ratio of martensite, so that it will be impossible to secure both strength and stretch flangeability.

[Tempering Condition]

As a tempering condition, for a range from a temperature after the annealing cooling to a tempering heating-temperature: 550 to 650° C., heating may be applied to the workpiece, and in the same temperature range, the workpiece may be held for tempering retention time: 3 to 30 s before cooling.

The higher the tempering heating-temperature is, the longer the tempering retention time is, and the more dislocation density will decrease. Further, the higher the tempering heating-temperature is, the longer the tempering retention time is, and the more the hardness of martensite will decrease.

However, a decrease rate of the dislocation density largely differs in respect of temperature-dependence and time-dependence from a fall rate of martensite hardness. While the decrease rate of the dislocation density has greater time-dependence, the fall rate of the martensite hardness has greater temperature-dependence.

Accordingly, in order to keep the dislocation density on a higher side than for a conventional steel, there is adopted retention time shorter than the tempering retention time for the conventional steel. Further, in order to cause the hardness of martensite to be rendered to 380 Hv or lower by tempering even in such a short retention time, it is useful to apply tempering at a heating temperature higher than the tempering heating-temperature for the conventional steel. By so doing, both values of two parameters such as dislocation density, and martensite hardness can be kept within appropriate ranges, respectively.

However, if tempering is applied at a temperature exceeding 650° C., the dislocation density will rapidly decrease by processing even in short time, resulting in insufficiency. Further, if the workpiece is held in long time in excess of 30 s, this will cause the dislocation density to undergo an excessive decrease, resulting in insufficiency, so that yield strength will not be obtained either. Meanwhile, if tempering is applied at a temperature lower than 550° C., or in retention time less than 3 s, the martensite hardness will not sufficiently fall, so that stretch flangeability is insufficient.

[Structure of the Steel Sheet According to the Fourth Aspect of The Invention]

The steel sheet according to the aspect of the invention, described as above, is based on the single-phase structure of tempered martensite, or the dual-phase structure (the ferrite plus the tempered martensite) as is the case with Patent Documents 2, 3. However, the steel sheet according to the fourth aspect of the invention differs from the steel sheets according to Patent Documents 2, 3, respectively, in that an area ratio of cementite of the tempered martensite, in particular, a size thereof, and an amount of solid solution carbon in the tempered martensite are controlled.

<Tempered Martensite: an Area Ratio 70% or More (100% Included)>

By forming a structure composed primarily of tempered martensite, strain concentration in ferrite that is a soft phase is suppressed, and the ferrite that is soft is prevented from first yielding, thereby enabling yield strength to be enhanced.

Stress concentration at an interface between the ferrite and the tempered martensite is checked, and occurrence of a crack at the interface is prevented, thereby securing stretch flangeability.

In order to effectively exhibit the function described as above, tempered martensite has an area 70% or more, more preferably 80% or more, or most preferably 90% or more (100% or more included). Further, the balance is ferrite.

<Cementite in Tempered Martensite: an Area Ratio, and the Diameter Of an Equivalent Circle: $(0.9f^{-1/2}-0.8)\times D\theta \leqq 6.5\times 10^{-1}$>

The yield strength of tempered martensite is dependent on four reinforcing mechanisms for solid solution reinforcement, dislocation reinforcement, boundary reinforcement by a block interface, and precipitation reinforcement by cementite. The precipitation reinforcement by cementite, among the four reinforcing mechanisms, strongly stops dislocation shift, and its contribution to enhancement in yield strength is very large. In this connection, it is known that precipitation reinforcement magnitude is inversely proportional to average grain spacing. And an average interparticle distance is dependent on a cementite area ratio f (%), and an average diameter Dθ (μm) of an equivalent circle of cementite, and is expressed by $(0.9f^{-1/2}-0.8)\times D\theta$(refer to "Iron and Steel, Precipitation Metallurgy—at the forefront", by Setsuo Takagi, et al., compiled by Japan Institute of Iron and Steel, 2001, p. 69).

As for the cementite area ratio f (%), since residual solid solution carbon does not exist in the steel according to the present invention, it is assumed that carbon [% C] contained in the steel is all precipitated as cementite. Accordingly, it is presumed that f=[% C]/6.69.

As a result of studies made on the average interparticle distance of a precipitate (cementite), necessary for attaining the yield strength 900 MPa at the required level, it has been found out that the average interparticle distance needs be 0.65 μm or less. From the above, expression (2) holds $$(0.9f^{-1/2}-0.8)\times D\theta \leqq 6.5\times 10^{-1} \quad (3)$$

where f=[% C]/6.69

The average interparticle distance of a precipitate is preferably $5\times 10^{-1}$ or less, or more preferably $4.0\times 10^{-1}$ or less.

<A Calorific Value Generated Between 400 to 600° C., as Measured by a Differential Scanning Calorimeter (Hereinafter Referred to Merely As [DSC]: 1 J/g or Less)>

Now, martensite contains a large amount of solid solution carbon at the time of quenching. By tempering the martensite, the solid solution carbon is precipitated in the form of fine cementite, thereby contributing to enhancement in yield strength by virtue of precipitation reinforcement. Meanwhile, solid solution carbon itself as well strongly contributes to enhancement in yield strength by virtue of solid solution reinforcement. However, as a result of studies made by comparing solid solution reinforcement by carbon with other reinforcing means, it has turned out that the solid solution reinforcement by carbon causes shift performance of dislocation to be largely lowered, thereby deteriorating ductility (elongation, in particular). For this reason, it has become apparent that, in the case of a small-thickness steel sheet of which good formability is required, it is better to lessen solid solution carbon in martensite as much as possible, and to secure yield strength by use of other reinforcing means (for example, precipitation reinforcement, in particular).

An amount of solid solution carbon in a steel sheet can be quantitatively evaluated with the use of a differential scanning calorimeter (DSC). That is, a calorific value accompanying precipitation of cementite, and so forth, rising in temperature, can be measured by the DSC, and since the calorific value is proportional to an amount of carbon in solid solution state, existing in the steel sheet, the amount of solid solution carbon in the steel sheet can be quantitatively evaluated.

As a result of studies made on relationships among a calorific value measured by the DSC, elongation, and stretch flangeability, it has turned out that if the calorific value in a range of 400 to 600° C. is 1 J/g or less, elongation (10% or more), and stretch flangeability (90% or more) can be obtained. The calorific value is preferably in a range 0.7 J/g or less, or more preferably in a range 0.5 J/g or less.

There are described methods for measuring an area ratio of tempered martensite, an average diameter of an equivalent circle of cementite, and a calorific value in a range of 400 to 600° C., measured by a DSC, respectively.

First, respective specimen steel sheets were subjected to mirror polishing to be corroded in a 3% niter solution to thereby expose a metallographic structure thereof, and subsequently, observation was made on images in five visual fields, respectively, picked up by a scanning electron microscope (SEM) of 20000×, the visual fields each covering a region of approximately 4 μm×3 μm, whereupon a part of the region, containing no cementite according to an image analysis, was defined as ferrite. Then a remaining part of the region was defined as martensite, and the area ratio of the martensite was worked out on the basis of area ratios of the respective parts of the region.

Then, the respective specimen steel sheets were subjected to mirror polishing to be corroded in a 3% niter solution to thereby expose the metallographic structure thereof, an observation was subsequently made on images in a visual field covering a region of 100 $\mu m^2$, picked up by a scanning electron microscope (SEM) of 10000× so as to enable the interior of martensite to be analyzed. As a result of the observation, a white portion on the basis of contrast in the image was determined as cementite particles, and a marking is affixed thereto, whereupon the diameter of an equivalent circle of each of the cementite particles with the marking was found, and the average diameter of an equivalent circle of cementite was worked out by calculating the arithmetic mean of those diameters.

FIG. 1 shows a method for measuring a calorific value with the use of the DSC by way of example. A columnar testpiece about 3 mm in diameter, about 1 mm in height, and about 50 mg in mass, extracted from the steel sheet by a wire cutter, was placed in a specimen holder made of $Al_2O_3$, and a measurement with the use of the DSC was made on a calorific value of $Al_2O_3$ that was used for a reference specimen under conditions that a rate of temperature rise was 10° C./min in an $N^2$ flow (flow rate: 50 mL/min). Further, a heat flow rate difference (mJ/s) was measured in 1.0 s increments.

As is evident from FIG. 1, it is shown that the heat flow rate difference was on the substantially monotonous increase along with a rise in temperature in a range of 150 to 250° C., but heat generation peaks appeared in a range of 250 to 500° C. The inventor, et al. have continued researches on the cause of emergence of such a phenomenon, and as a result, they have succeeded in determining that the peak in a range of 250 to 400° C. is attributable to heat generation due to decomposition of residual austenite, and on the other hand, the peak in a range of 400 to 600° C. attributable to heat generation occurring upon precipitation of supersaturated solid solution carbon contained in the steel sheet into a carbide.

On the basis of the above, an area sandwiched between a curve indicating heat generation seen in a range of 400 to 600° C., and a reference line obtained by causing variation in heat flow rate difference in a range of 150 to 250° C. to approximate a straight line (an area above the reference line in the steel according to the present invention, that is, a diagonally shaded area in FIG. 1) corresponds to a total calorific value when the supersaturated solid solution carbon is precipitated as a carbide. This area (namely, the total calorific value) is divided by mass of the specimen, thereby working out a calorific value per unit mass.

The steel sheet according to the fourth aspect of the invention has the fundamental component composition according to the present invention. However, the Si content thereof is preferably in a range of 0.1 to 3.0 mass % for the following reason. Si as a solid solution reinforcement element is capable of enhancing yield strength without causing deterioration in elongation, having also an effect of suppressing coarsening of cementite particles present in martensite at the time of tempering. If the Si content is less than 0.10 mass %, a function described as above cannot be effectively exhibited. On the other hand, if the Si content exceeds 3.0 mass %, this will block formation of austenite at the time of heating, so that it is impossible to secure an area ratio of martensite, resulting in failure to secure yield strength and stretch flangeability.

With the steel sheet according to the fourth aspect of the invention, the Si content is preferably in a range of 0.30 to 2.5 mass %, or more preferably in a range of 0.50 to 2.0 mass %.

Further, Mn as well is within the range according to the fundamental component composition of the steel sheet according to the present invention, and with the steel sheet according to the fourth aspect of the invention, the Mn content is preferably in a range of 1.0 to 5.0 mass %. As is the case with Si, Mn as a solid solution reinforcement element is capable of enhancing yield strength without causing deterioration in elongation, having also an effect of suppressing coarsening of cementite at the time of tempering. If the Mn content is less than 1.0 mass %, it will be impossible to effectively exhibit a function for solid solution reinforcement, and a function for suppressing coarsening of cementite, and in addition, bainite is formed at the time of rapid cooling for quenching, resulting in insufficiency in area ratio of martensite, so that yield strength, and stretch flangeability cannot be secured. On the other hand, if the Mn content exceeds 5.0 mass %, residual austenite will remain at the time of quenching (upon cooling after heating for annealing), thereby causing deterioration in stretch flangeability. The Mn content is preferably in a range of 1.2 to 4.0 mass %, or more preferably in a range of 1.5 to 3.0 mass %.

Furthermore, it is necessary for the steel sheet according to the fourth aspect of the invention to positively contain Cr, in which case, the Cr content thereof is in a range of 0.5 to 3.0 mass %.

In order to minimize residual solid solution carbon in the steel sheet for the purpose of securing ductility of the steel sheet, there is the need for tempering at a high temperature. However, if tempering is applied at a high temperature, this will cause coarsening of cementite precipitated from solid solution carbon, thereby presenting problems in that stretch flangeability undergo deterioration, and yield strength as well undergo deterioration due to expansion of a free mean pass of a precipitate.

Mn as well as Si is an element having the effect of suppressing coarsening of cementite, however, since effects of those elements alone are insufficient, sufficient advantageous effects cannot be obtained without addition of a suitable amount of Cr having a stronger function of suppressing coarsening of cementite. If the Cr content thereof is less than 0.5 mass %, it will be impossible to effectively exhibit the function for suppressing coarsening of cementite. On the other hand, if the Cr content exceeds 3.0 mass %, residual austenite will be formed at the time of quenching, thereby causing deterioration in yield strength, and stretch flangeability. The Cr content is preferably in a range of 0.6 to 2.5 mass %, or more preferably in a range of 0.9 to 2.0 mass %.

[Preferable Method for Manufacturing the Steel Sheet according to The Fourth Aspect of the Invention]

Next, there is described hereinafter a preferable manufacturing method for obtaining the steel sheet according to the fourth aspect of the invention.

In order to manufacture the cold rolled steel sheet according to the fourth aspect of the invention, a steel having the component composition described in the foregoing is first produced in hot metal state to be turned into a slab by casting into an ingot, or continuous casting before being subjected to hot rolling. Under hot rolling conditions, the termination temperature of finish rolling is set to an $Ar_3$ point or higher, and after cooling as appropriate, a workpiece is rolled up at a temperature in a range of 450 to 700°. After completion of the hot rolling, pickling is carried out to be followed by cold rolling, and in the cold rolling, a reduction ratio on the order of 30% or higher is preferably adopted.

Further, the cold rolling is followed by annealing and tempering is further carried out.

[Annealing Conditions]

Under annealing conditions, a workpiece is heated to an annealing heating-temperature: [0.3×Ac1+0.7×Ac3] to 1000° C. to be held for annealing retention time: 3600 s or less, and subsequently, the workpiece is preferably quenched from the annealing heating-temperature directly to a temperature at an Ms point or lower at a cooling rate of 50° C./s or more. Otherwise, the workpiece is preferably slow-cooled from the annealing heating-temperature to a temperature lower than the annealing heating-temperature, and at 620° C. or higher (a first cooling completion temperature) at a cooling rate of 1° C./s or more (a first cooling rate), before being preferably quenched to a temperature at the Ms point or lower (a second cooling completion temperature) at a cooling rate of 50° C./s or less (a second cooling rate).

<Annealing Heating-Temperature: [0.3×Ac1+0.7×Ac3] to 1000° C., Annealing Retention Time: 3600 s or Less>

In so doing, the workpiece is sufficiently transformed in phase to austenite at the time of annealing heating to secure an area ratio 70% or more for martensite that is formed by transformation from the austenite at the time of subsequent cooling.

If the annealing heating-temperature is lower than [0.3×Ac1+0.7×Ac3]° C., an amount of austenite transformed at the time of annealing heating is insufficient, and an amount of martensite formed by transformation from the austenite at the time of subsequent cooling will decrease, so that the area ratio 70% or more of martensite cannot be secured. On the other hand, if the annealing heating-temperature exceeds 1000° C., this will coarsen an austenite structure to thereby cause deterioration not only in bendability and toughness of the steel sheet but also in annealing facilities, and such a condition is therefore undesirable.

Further, if the annealing retention time exceeds 3600 s, this will render productivity extremely poorer, and such a condition is therefore undesirable.

<Quenching to a Temperature at an Ms Point or Lower at a Cooling Rate of 50° C./s or More>

In so doing, which formation of ferrite and bainite structures from austenite during cooling is suppressed to thereby enable martensite to be obtained.

If quenching is terminated at a temperature higher than the Ms point, or the cooling rate is less than 50° C./s, this will cause bainite to be formed, so that the strength of the steel sheet cannot be secured.

<Slow-Cooling to a Temperature Lower than the Annealing Heating-Temperature, And at 620° C. or Higher, at a Cooling Rate of 1° C./s or More>

In so doing, a ferrite structure with an area ratio less than 30% is formed, thereby rendering it possible to aim at improvement in elongation while securing stretch flangeability.

At a temperature lower than 620° C., or at a cooling rate less than 1° C./s, ferrite is excessively formed, resulting in an insufficient area ratio of martensite, so that it will be impossible to secure both yield strength and stretch flangeability.

[Tempering Condition]

As a tempering condition, heating is applied in a range from the temperature after the annealing cooling to the heating-temperature T: 520° C. or higher, and it will be sufficient if the workpiece is held at the temperature T under conditions that retention time t(s) is expressed by formula $8\times10^{-4}<P=\exp[-9649/(T+273)]\times t<2.0\times10^{-3}$ before cooling.

Further, in the case of changing the temperature T during the retention time, use can be made of expression (9) given hereunder.

[formula 2]

$$P=\int_0^t \exp\left(-\frac{9649}{(T(t)+273)}\right)\cdot dt \qquad \text{expression (9)}$$

The workpiece is heated in a temperature range at 520° C. or higher, and held therein, thereby urging cementite to be precipitated, so that consumption of solid solution carbon is promoted.

<Heating Up to the Heating-Temperature T: 520° C. or Higher, and Holding at the Temperature T Under Conditions of the Retention Time t(s) Expressed by Formula, $8\times10^{-4}<P=\exp[-9649/(T+273)]\times t<2.0\times10^{-3}$>

Herein, $P=\exp[-9649/(T+273)]\times t$ is a parameter for stipulating a size of a cementite particle as a precipitate, obtained by setting and simplifying the parameter on the basis of a precipitate grain growth model, described in expressions (4, 18), p. 106, "Material Metallography", by Koichi Sugimoto, et al., published by Asakura Publishing Co., Ltd.

If the heating-temperature T is lower than 520° C., precipitation of cementite will be insufficient even when the retention time t is lengthened, resulting in an increase in the amount of residual solid solution carbon, so that elongation cannot be secured.

In the case of $P=\exp[-9649/(T+273)]\times t\leqq 8\times10^{-4}$, precipitation of cementite will be insufficient, resulting in an increase in the amount of residual solid solution carbon, so that elongation cannot be secured either.

In the case of $P=\exp[-9649/(T+273)]\times t\ 2.0\times10^{-3}$, cementite particles undergo coarsening, resulting in an increase in interparticle distance of cementite, so that yield strength cannot be secured.

There are described hereinafter addable elements that can be added in addition to the fundamental component composition of the steel sheet according to the present invention.

In the case of the first to the third aspects of the invention, Cr content in a range of 0.01 to 1.0 mass % is preferably added. Cr is a useful element in increasing a precipitation reinforcement amount while checking deterioration in stretch flangeability by precipitating fine carbide thereof in place of cementite. If an addition amount of Cr is less than 0.01 mass %, it will be impossible to effectively exhibit such a function as described above. On the other hand, if the addition amount of Cr exceeds 1.0 mass %, precipitation reinforcement will be excessive, thereby rendering the hardness of martensite excessively high, so that stretch flangeability undergo deterioration.

In the case of the first to the fourth aspects of the invention, Mo content in a range of 0.01 to 1.0 mass % is preferably added. As is the case with Cr, Mo is a useful element in increasing a precipitation reinforcement amount while checking deterioration in stretch flangeability by precipitating fine carbide thereof in place of cementite. If an addition amount of Mo is less than 0.01 mass %, it will be impossible to effectively exhibit such a function as described above. On the other hand, if the addition amount of Mo exceeds 1.0 mass %, precipitation reinforcement will be excessive, thereby rendering the hardness of martensite excessively high, so that stretch flangeability undergo deterioration.

In the case of the first to the fourth aspects of the invention, addition of Cu in a range of 0.05 to 1.0 mass %, and/or Ni in a range of 0.05 to 1.0 mass % is preferable.

Those elements are useful in rendering it easier to obtain suitably fine cementite by checking growth of the cementite, thereby improving balance between elongation, and stretch flangeability. If an addition amount of either of the elements is less than 0.05 mass %, it will be impossible to effectively exhibit such a function as described above. On the other hand, if the addition amount thereof exceeds 1.0 mass %, residual austenite will remain at the time of quenching, thereby causing deterioration in stretch flangeability.

In the case of the first to the fourth aspects of the invention, further addition of Ca in a range of 0.0005 to 0.01 mass %, and/or Mg content in a range of 0.0005 to 0.01 mass % is preferable.

Those elements are useful in enhancing stretch flangeability by micronizing inclusions to thereby lessen the number of stating points for fracture. If an addition amount of either of the elements is less than 0.0005 mass %, it will be impossible to effectively exhibit such a function as described above. On the other hand, if the addition amount thereof exceeds 0.01 mass %, the inclusions will undergo coarsening to the contrary, thereby causing deterioration in stretch flangeability.

In the case of the first to the fourth aspects of the invention, further addition of B in a range of 0.0002 to 0.0030 mass % is preferable.

B is an element useful in enhancing yield strength and stretch flangeability by enhancing hardenability to thereby contribute to securing of a martensite area ratio. If an addition of B is less than 0.0002 mass %, it will be impossible to effectively exhibit such a function as described above. On the other hand, if the addition amount of B exceeds 0.0030 mass %, residual austenite will remain at the time of quenching, thereby causing deterioration in stretch flangeability.

In the case of the first to the fourth aspects of the invention, further addition of REM in a range of 0.0005 to 0.01 mass % is preferable.

REM is an element useful in enhancing stretch flangeability by micronizing inclusions to thereby lessen the number of stating points for fracture. If an addition of REM is less than 0.0005 mass %, it will be impossible to effectively exhibit such a function as described above. On the other hand, if the addition amount of REM exceeds 0.01 mass %, the inclusions will undergo coarsening to the contrary, thereby causing deterioration in stretch flangeability.

REM indicates rare earth elements, that is, IIIA group elements on the periodic table of the elements.

WORKING EXAMPLES

Working Examples of the Steel Sheet According to the First Aspect of the Invention Respective steels, each having a specific composition shown in Table 1, were melted to be formed into an ingot 120 mm in thickness. The ingot was hot rolled to a thickness 25 mm to be hot rolled again to a thickness 3.2 mm. A workpiece was pickled to be subsequently cold rolled to a thickness 1.6 mm, thereby obtaining a steel sheet serving as a specimen. Heat treatments under various conditions shown in Table 1 were applied to the steel sheet.

TABLE 1

| Steel | Component (mass %) | | | | | | | | | | | | | (Ac1 + Ac3)/2 |
|---|---|---|---|---|---|---|---|---|---|---|---|---|---|---|
| type | C | Si | Mn | P | S | N | Al | Cr | Mo | Cu | Ni | Ca | Mg | (° C.) |
| $A_1$ | 0.16 | 1.20 | 2.00 | 0.001 | 0.002 | 0.004 | 0.031 | — | — | — | — | 0.0010 | — | 809 |
| $B_1$ | 0.15 | 1.24 | 2.07 | 0.001 | 0.005 | 0.004 | 0.030 | — | — | — | — | — | — | 812 |
| $C_1$ | 0.15 | 1.22 | 2.00 | 0.001 | 0.012* | 0.004 | 0.030 | — | — | — | — | — | — | 812 |
| $D_1$ | 0.01 | 1.25 | 2.07 | 0.001 | 0.002 | 0.004 | 0.031 | — | — | — | — | 0.0010 | — | 841 |
| $E_1$ | 0.26 | 1.23 | 2.09 | 0.001 | 0.002 | 0.004 | 0.031 | — | — | — | — | 0.0010 | — | 799 |
| $F_1$ | 0.41* | 1.21 | 2.01 | 0.001 | 0.002 | 0.004 | 0.030 | — | — | — | — | 0.0010 | — | 785 |
| $G_1$ | 0.15 | 0.10* | 2.04 | 0.001 | 0.002 | 0.004 | 0.031 | — | — | — | — | 0.0010 | — | 770 |
| $H_1$ | 0.15 | 1.85 | 2.04 | 0.001 | 0.002 | 0.004 | 0.030 | — | — | — | — | 0.0010 | — | 835 |
| $I_1$ | 0.16 | 3.14* | 2.02 | 0.001 | 0.002 | 0.004 | 0.031 | — | — | — | — | 0.0010 | — | 881 |
| $J_1$ | 0.16 | 1.22 | 0.05* | 0.001 | 0.002 | 0.004 | 0.030 | — | — | — | — | 0.0010 | — | 821 |
| $K_1$ | 0.16 | 1.21 | 1.26 | 0.001 | 0.002 | 0.004 | 0.031 | — | — | — | — | 0.0010 | — | 814 |
| $L_1$ | 0.15 | 1.21 | 3.11 | 0.001 | 0.002 | 0.004 | 0.031 | — | — | — | — | 0.0010 | — | 805 |
| $M_1$ | 0.15 | 1.25 | 6.19* | 0.001 | 0.002 | 0.004 | 0.031 | — | — | — | — | 0.0010 | — | 790 |
| $N_1$ | 0.15 | 1.24 | 2.02 | 0.001 | 0.002 | 0.004 | 0.031 | 0.50 | — | — | — | 0.0010 | — | 816 |
| $O_1$ | 0.15 | 1.25 | 2.08 | 0.001 | 0.002 | 0.004 | 0.030 | — | 0.20 | — | — | 0.0010 | — | 815 |
| $P_1$ | 0.15 | 1.23 | 2.07 | 0.001 | 0.002 | 0.004 | 0.031 | — | — | 0.40 | — | 0.0010 | — | 812 |
| $Q_1$ | 0.16 | 1.23 | 2.06 | 0.001 | 0.002 | 0.004 | 0.031 | — | — | — | 0.50 | 0.0010 | — | 802 |
| $R_1$ | 0.16 | 1.22 | 2.03 | 0.001 | 0.002 | 0.004 | 0.030 | — | — | — | — | — | 0.0010 | 810 |

(*Indicating departure from the range according to the present invention.)

TABLE 2

| | First annealing condition | | Second annealing condition | | | | | |
|---|---|---|---|---|---|---|---|---|
| Heat treatment | Heating temperature (° C.) | Retention time (s) | Heating temperature (° C.) | Retention time (s) | First cooling rate (° C./s) | First cooling completion temperature (° C.) | Second cooling rate (° C./s) | Second cooling completion temperature (° C.) |
| $a_1$ | 1150 | 180 | 900 | 120 | 20 | 675 | 200 | 20 |
| $b_1$ | No heating* | | 900 | 120 | 20 | 675 | 200 | 20 |
| $c_1$ | 920* | 180 | 900 | 120 | 20 | 675 | 200 | 20 |

TABLE 2-continued

| | | | | | | | | |
|---|---|---|---|---|---|---|---|---|
| $d_1$ | 1150 | 10* | 900 | 120 | 20 | 675 | 200 | 20 |
| $e_1$ | 1150 | 180 | 900 | 120 | 20 | 580* | 200 | 20 |
| $f_1$ | 1150 | 180 | 900 | 120 | 20 | 675 | 200 | 20 |
| $g_1$ | 1150 | 180 | 900 | 120 | 20 | 675 | 200 | 20 |
| $h_1$ | 1150 | 180 | 900 | 120 | 20 | 675 | 200 | 20 |
| $i_1$ | 1150 | 180 | 900 | 120 | 20 | 675 | 200 | 20 |
| $j_1$ | 1150 | 180 | 900 | 120 | 20 | 675 | 200 | 20 |
| $k_1$ | 1150 | 180 | 800* | 120 | 20 | 675 | 200 | 20 |
| $l_1$ | 1150 | 180 | 900 | 120 | 20 | 700 | 200 | 20 |

| | Tempering condition | | | | | | |
|---|---|---|---|---|---|---|---|
| | Average heating rate | First stage heating temperature | First stage retention time | Second stage heating temperature | Second stage retention time | Parameters | |
| Heat treatment | (° C./s) | (° C.) | (s) | (° C.) | (s) | Pt | Pg |
| $a_1$ | 20 | 350 | 60 | 500 | 180 | 14884 | $6.9 \times 10^{-4}$ |
| $b_1$ | 20 | 350 | 60 | 500 | 180 | 14884 | $6.9 \times 10^{-4}$ |
| $c_1$ | 20 | 350 | 60 | 500 | 180 | 14884 | $6.9 \times 10^{-4}$ |
| $d_1$ | 20 | 350 | 60 | 500 | 180 | 14884 | $6.9 \times 10^{-4}$ |
| $e_1$ | 20 | 350 | 60 | 500 | 180 | 14884 | $6.9 \times 10^{-4}$ |
| $f_1$ | 20 | 200* | 60 | 500 | 180 | 14884 | $6.9 \times 10^{-4}$ |
| $g_1$ | 20 | 450* | 60 | 500 | 180 | 14884 | $6.9 \times 10^{-4}$ |
| $h_1$ | 20 | 350 | 60 | 400* | 180 | 12958 | $1.1 \times 10^{-4}$ |
| $i_1$ | 20 | 350 | 60 | 600 | 180* | 16809 | $2.9 \times 10^{-3}$* |
| $j_1$ | 20 | —* | —* | 500 | 180 | 14884 | $6.9 \times 10^{-4}$ |
| $k_1$ | 20 | 350 | 60 | 500 | 180 | 14884 | $6.9 \times 10^{-4}$ |
| $l_1$ | 20 | 350 | 60 | 470 | 180 | 14307 | $4.1 \times 10^{4}$ |

(*Indicating departure from the recommended range according to the present invention.)

In accordance with the respective measuring methods described under the heading [BEST MODE FOR CARRYING OUT THE INVENTION], measurements for the area ratio of tempered martensite, the hardness thereof, the size of a cementite particle, the number of the cementite particles, the aspect ratio of an inclusion, and the number of the inclusions, respectively, were made on the respective steel sheets with the heat treatment applied thereto.

Further, measurements for tensile strength TS, and stretch flangeability λ, respectively, were made on the respective steel sheets. A test piece referred to as No. 5 test piece in JIS Z 2201, with its long axis oriented in a direction at right angles to a rolling direction, was prepared, and a measurement for tensile strength TS was made on the test piece in accordance with JIS Z 2241. Further, stretch flangeability λ was found by conducting a hole expanding test according to Iron and Steel Federation specification JFST 1001, thereby measuring a hole expanding ratio. Table 3 shows results of those measurements.

TABLE 3

| Steel No. | Steel type | Heat treatment | Tempered martensite area ratio VM (%) | Ferrite area ratio VF (%) | Other structure area ratio (%) | Tempered martensite hardness HvM | Vickers hardness Hv | Ferrite hardness HvF |
|---|---|---|---|---|---|---|---|---|
| 1 | $A_1$ | $a_1$ | 85 | 15 | 0 | 349 | 321 | 161 |
| 2 | $B_1$ | $a_1$ | 85 | 15 | 0 | 347 | 319 | 162 |
| 3 | $C_1$ | $a_1$ | 85 | 15 | 0 | 349 | 321 | 161 |
| 4 | $D_1$ | $a_1$ | 40* | 60 | 0 | 252 | 198 | 162 |
| 5 | $E_1$ | $a_1$ | 95 | 5 | 0 | 367 | 357 | 161 |
| 6 | $F_1$ | $a_1$ | 100 | 0 | 0 | 360 | 360 | — |
| 7 | $G_1$ | $a_1$ | 95 | 5 | 0 | 317 | 308 | 130 |
| 8 | $H_1$ | $a_1$ | 80 | 20 | 0 | 374 | 335 | 178 |
| 9 | $I_1$ | $a_1$ | 70 | 30 | 0 | 426* | 361 | 210 |
| 10 | $J_1$ | $a_1$ | 75 | 25 | 0 | 328 | 281 | 141 |
| 11 | $K_1$ | $a_1$ | 80 | 20 | 0 | 336 | 299 | 152 |
| 12 | $L_1$ | $a_1$ | 95 | 5 | 0 | 333 | 325 | 172 |
| 13 | $M_1$ | $a_1$ | 80 | 0 | 20* | — | 369 | 202 |
| 14 | $N_1$ | $a_1$ | 95 | 5 | 0 | 343 | 334 | 156 |
| 15 | $O_1$ | $a_1$ | 95 | 5 | 0 | 344 | 335 | 162 |
| 16 | $P_1$ | $a_1$ | 95 | 5 | 0 | 354 | 345 | 165 |
| 17 | $Q_1$ | $a_1$ | 95 | 5 | 0 | 345 | 336 | 160 |
| 18 | $R_1$ | $a_1$ | 95 | 5 | 0 | 327 | 319 | 161 |
| 19 | $A_1$ | $b_1$ | 85 | 15 | 0 | 350 | 322 | 162 |
| 20 | $A_1$ | $c_1$ | 85 | 15 | 0 | 347 | 319 | 162 |
| 21 | $A_1$ | $d_1$ | 85 | 15 | 0 | 348 | 320 | 162 |
| 22 | $A_1$ | $e_1$ | 40* | 60 | 0 | 407* | 260 | 162 |
| 23 | $A_1$ | $f_1$ | 85 | 15 | 0 | 346 | 318 | 162 |
| 24 | $A_1$ | $g_1$ | 85 | 15 | 0 | 351 | 323 | 162 |
| 25 | $A_1$ | $h_1$ | 85 | 15 | 0 | 420* | 381 | 162 |

TABLE 3-continued

| | | | | | | | | |
|---|---|---|---|---|---|---|---|---|
| 26 | $A_1$ | $i_1$ | 85 | 15 | 0 | 303 | 282 | 162 |
| 27 | $A_1$ | $j_1$ | 85 | 15 | 0 | 346 | 318 | 162 |
| 28 | $A_1$ | $k_1$ | 35* | 65 | 0 | 462* | 267 | 162 |
| 29 | $B_1$ | $l_1$ | 100 | 0 | 0 | 375 | 375 | — |

| Steel No. | Number of cementite particles 0.1 or more in diameter of equivalent circle (pcs./μm$^2$) | Number of inclusions 2.0 or more in aspect ratio (pcs./mm$^2$) | Number of all inclusions (pcs./mm$^2$) | TS (MPa) | λ (%) | Remarks |
|---|---|---|---|---|---|---|
| 1 | 1.7 | 110 | 1783 | 1066 | 138 | Working example |
| 2 | 1.7 | 189 | 1950 | 1027 | 126 | Working example |
| 3 | 1.6 | 753* | 2307 | 1051 | 78* | Comparative example* |
| 4 | 0.2 | 108 | 2318 | 646* | 85* | Comparative example* |
| 5 | 2.1 | 103 | 1933 | 1182 | 125 | Working example |
| 6 | 4.3* | 147 | 2160 | 1181 | 80* | Comparative example* |
| 7 | 2.7* | 121 | 1714 | 1020 | 112* | Comparative example* |
| 8 | 1.3 | 145 | 2443 | 1069 | 141 | Working example |
| 9 | 1.1 | 93 | 2103 | 1180 | 71* | Comparative example* |
| 10 | 4.6* | 96 | 1799 | 914* | 72* | Comparative example* |
| 11 | 2.1 | 113 | 1511 | 990 | 128 | Working example |
| 12 | 1.3 | 129 | 2084 | 1074 | 143 | Working example |
| 13 | 0.9 | 90 | 1521 | 1193 | 28* | Comparative example* |
| 14 | 1.3 | 112 | 1955 | 1093 | 141 | Working example |
| 15 | 1.4 | 142 | 1959 | 1080 | 143 | Working example |
| 16 | 1.6 | 138 | 1975 | 1126 | 139 | Working example |
| 17 | 1.7 | 127 | 1804 | 1110 | 140 | Working example |
| 18 | 1.7 | 105 | 2263 | 1024 | 137 | Working example |
| 19 | 1.7 | 315* | 1507 | 1036 | 108* | Comparative example* |
| 20 | 1.7 | 300* | 1658 | 1054 | 113* | Comparative example* |
| 21 | 1.7 | 307* | 2179 | 1025 | 111* | Comparative example* |
| 22 | 2.2 | 116 | 1708 | 858* | 28* | Comparative example* |
| 23 | 5.3* | 80 | 1908 | 1055 | 77* | Comparative example* |
| 24 | 6.0* | 91 | 2489 | 1070 | 59* | Comparative example* |
| 25 | 1.2 | 105 | 1592 | 1239 | 85* | Comparative example* |
| 26 | 4.4* | 76 | 2355 | 916* | 72* | Comparative example* |
| 27 | 3.9* | 126 | 1537 | 1030 | 94* | Comparative example* |
| 28 | 2.9* | 119 | 1746 | 861* | 45* | Comparative example* |
| 29 | 2.3 | 89 | 1820 | 1211 | 121 | Working example |

(*Indicating departure from the range according to the present invention)

As shown in Table 3, working examples, Steel Nos. 1, 2, 5, 8, 11, 12, 14 to 18, and 29 each were found having tensile strength TS at 980 MPa or higher, and stretch flangeability (a hole expanding ratio) λ at 125% or more. That is, there was obtained a high-strength cold-rolled steel sheet meeting a level of requirements described in a paragraph under the heading BACKGROUND TECHNOLOGY.

In contrast, comparative examples, Steel Nos. 3, 4, 6, 7, 9, 10, 13, 19 to 28, each were found inferior in at least any of properties.

For example, in the case of Steel No. 3, the S content was excessively high, and therefore, the number of inclusions was too many, so that stretch flangeability was found inferior although tensile strength was excellent.

In the case of Steel No. 4, an area ratio of tempered martensite was less than 50%, and therefore, both tensile strength, and stretch flangeability were found inferior.

Further, in the case of Steel No. 6, the C content thereof was too high, so that the number of coarsened cementite particles increased although an area ratio of tempered martensite was 50% or more. Accordingly, Steel No. 6 was found excellent in tensile strength, but inferior in stretch flangeability.

Further, in the case of Steel No. 7, the C content thereof was too low, so that the number of coarsened cementite particles was too many although an area ratio of tempered martensite was 50% or more. Accordingly, Steel No. 7 was found excellent in tensile strength, but inferior in stretch flangeability.

Further, in the case of Steel No. 9, the hardness thereof was too high although an area ratio of tempered martensite was 50% or more. Accordingly, Steel No. 9 was found excellent in tensile strength, but inferior in stretch flangeability.

Further, in the case of Steel No. 10, the Mn content thereof was too low, so that cementite particles underwent coarsening. Accordingly, Steel No. 10 was found excellent in tensile strength and elongation, but inferior in stretch flangeability.

Further, in the case of Steel No. 13, the Mn content thereof was too low, and therefore, residual austenite remained at the time of quenching (upon cooling after heating for annealing, so that Steel No. 13 was found excellent in tensile strength, but inferior in stretch flangeability.

In the case of Steel Nos. 19 to 21, at the time of the first annealing, an annealing heating-temperature, and/or annealing retention time were insufficient, so that the number of inclusions 2.0 or more in aspect ratio did not sufficiently decrease. Accordingly, Steel Nos. 19 to 21 each was found excellent in tensile strength, but inferior in stretch flangeability.

Further, with Steel Nos. 22 to 28, at least one of requirements for controlling the structure according to the present invention was not satisfied because of departure of the second annealing condition or the tempering condition from the range recommended by the first aspect of the present invention, so that Steel Nos. 22 to 28 each were found inferior in at least stretch flangeability.

Now, the following analysis was made by use of data of steels having component composition and the constituents of the matrix structure thereof, meeting the respective ranges as set forth by the present invention, the date being among data shown in Table 3.

Figure 3:
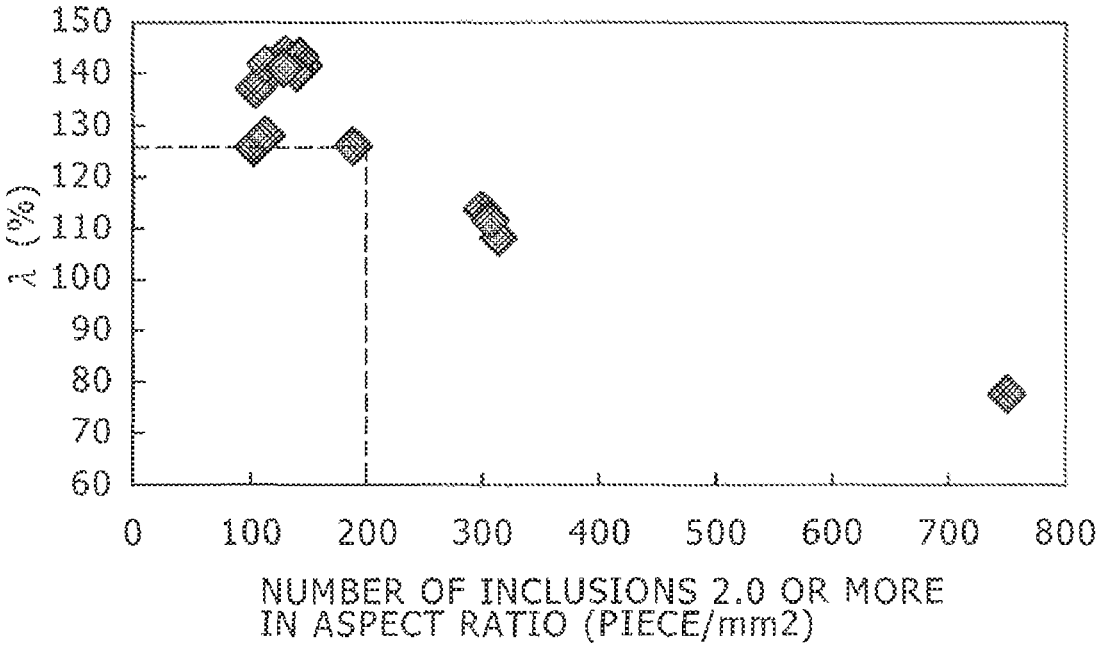
FIG. 3 is a graph showing a relationship between the number of inclusions slender in shape, 2.0 or more in aspect ratio, present in the whole structure, and the stretch flangeability (the hole expanding ratio)
Figure 4:
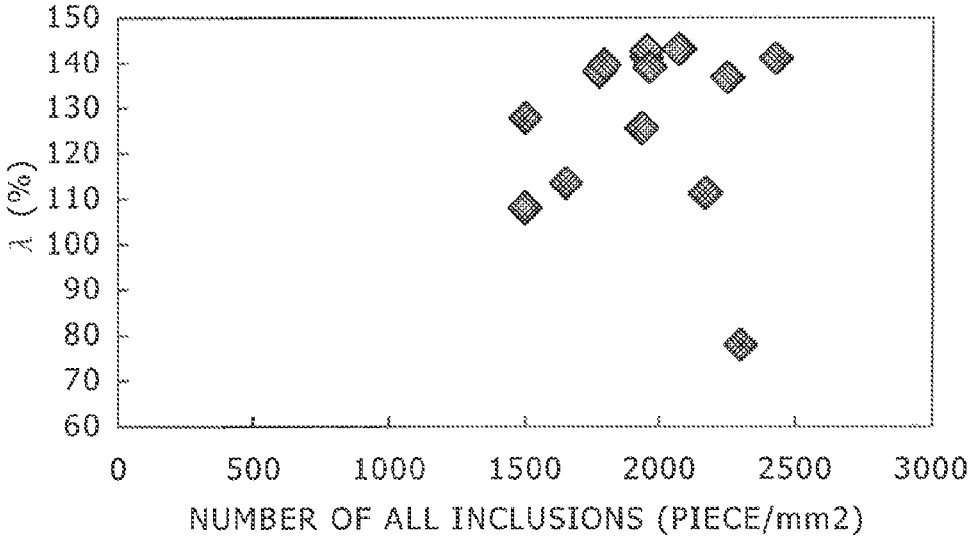
FIG. 4 is a graph showing a relationship between the number of all inclusions, present in the whole structure, and the stretch flangeability (the hole expanding ratio)

First, degrees of effects of the number of cementite particles, and the number of inclusions, exerting on stretch flangeability (a hole expanding ratio) λ were sorted out, and as a result, FIGS. 2 to 4 were obtained.

As shown in FIG. 2, stretch flangeability (a hole expanding ratio) λ drops substantially along a straight line following an increase in the number of coarse cementite particles 0.1 μm or more in the diameter of an equivalent circle. Accordingly, it is evident that there is the need for controlling the number of the coarse cementite particles to 2.3 pieces or less per 1 $\mu m^2$ in order to secure λ≧125%.

Further, as shown in FIG. 3, stretch flangeability (a hole expanding ratio) λ drops substantially along a straight line following an increase in the number of inclusions slender in shape, 2.0 or more in aspect ratio. Accordingly, it is evident that there is the need for controlling the number of the inclusions slender in shape to 200 pieces or less per 1 mm in order to secure λ≧125%.

Further, as shown in FIG. 4, there was not seen an obvious correlation between the stretch flangeability (the hole expanding ratio) λ, and the number of all inclusions.

Figure 5:
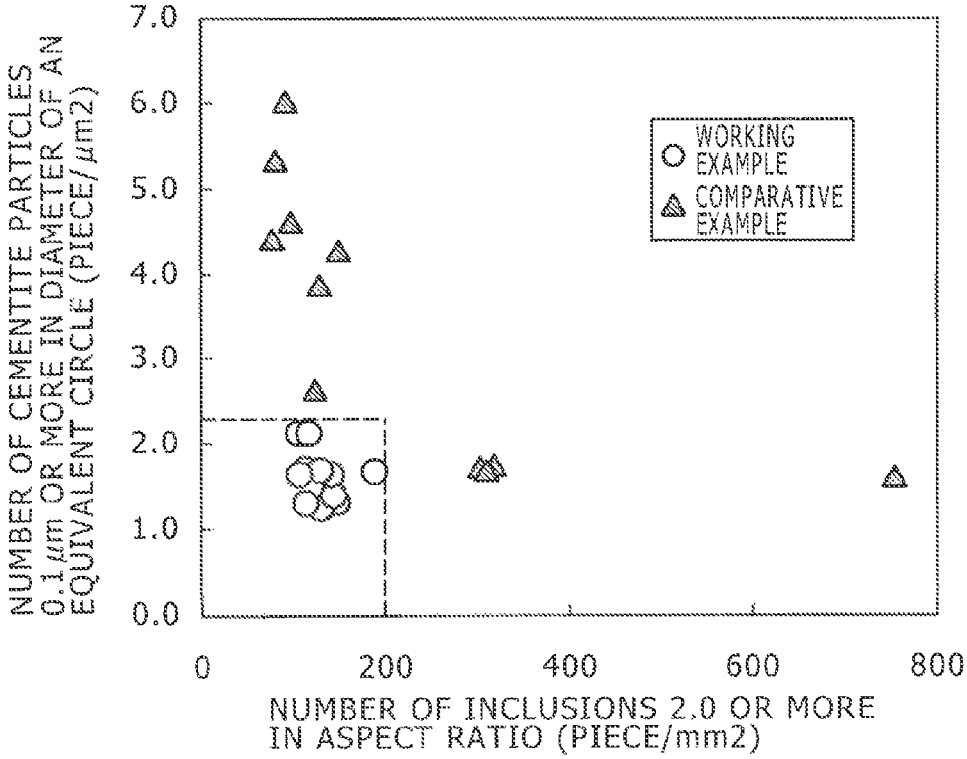
FIG. 5 is a graph showing a proper range for combinations between the number of the inclusions 2.0 or more in aspect ratio, and the number of the cementite particles 0.1 μm or more in the diameter of an equivalent circle.

In order to check an appropriate range for combination of the number of inclusions slender in shape, 2.0 or more in aspect ratio, and the number of coarse cementite particles 0.1 μm or more in diameter of an equivalent circle, according to the present invention, there was prepared a graph where those two parameters each are indicated along the vertical axis, and the horizontal axis, respectively, and data of working examples, and data of comparative examples were plotted on the graph, as shown in FIG. 5. As is evident from FIG. 5, with the present invention, there are needs for the number of cementite particles 0.1 μm or more in the diameter of an equivalent circle: 2.3 pieces or less per 1 $\mu m^2$, and the number of inclusions 2.0 or more in aspect ratio: 200 pieces or less per 1 $mm^2$.

Figure 6:
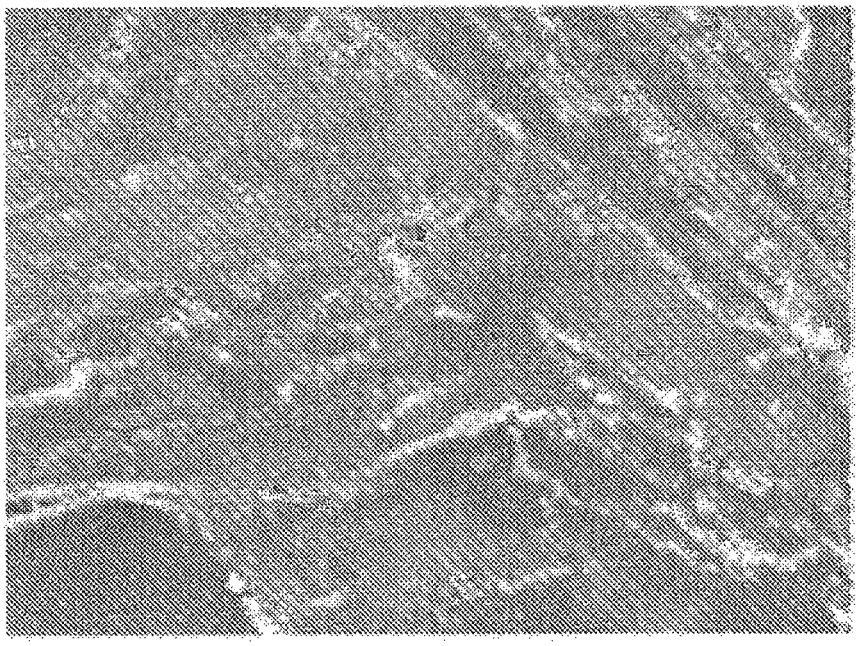
FIG. 6 each are a view showing a distribution state of cementite particles in a martensite structure.
Figure 6:
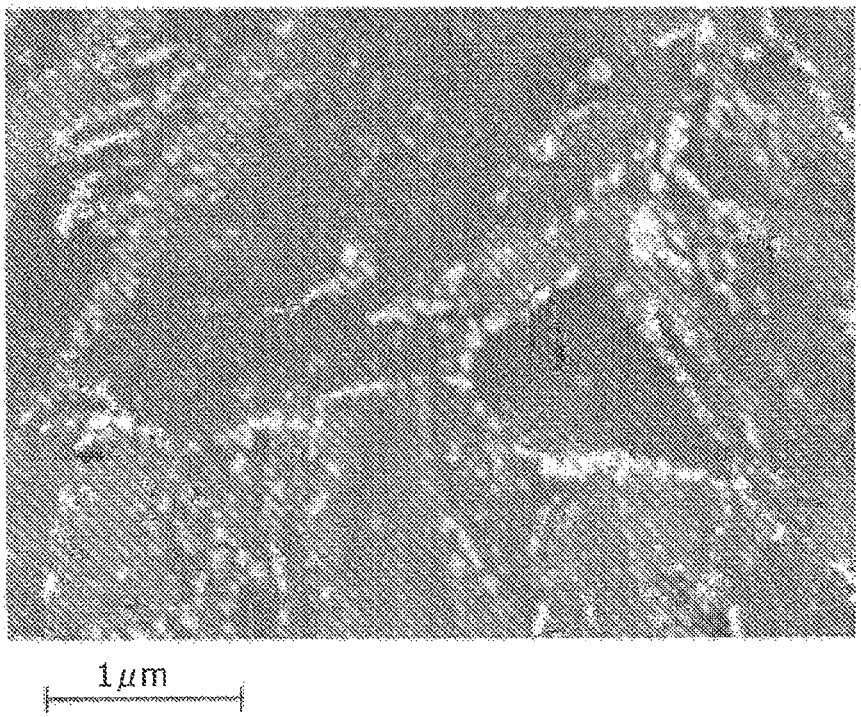

FIG. 6 show distribution states of cementite particles in a tempered martensite structure of the working example (Steel No. 1), and the comparative example (Steel No. 23), respectively, by way of example. FIG. 6 each show the result of observation by an SEM, in which white parts each represent a cementite particle. As is evident from FIG. 6, it can be observed that fine cementite particles are evenly dispersed in the working example, and coarse cementite particles are hardly seen, whereas a large number of coarse cementite particles are seen in the comparative example.

Figure 7:
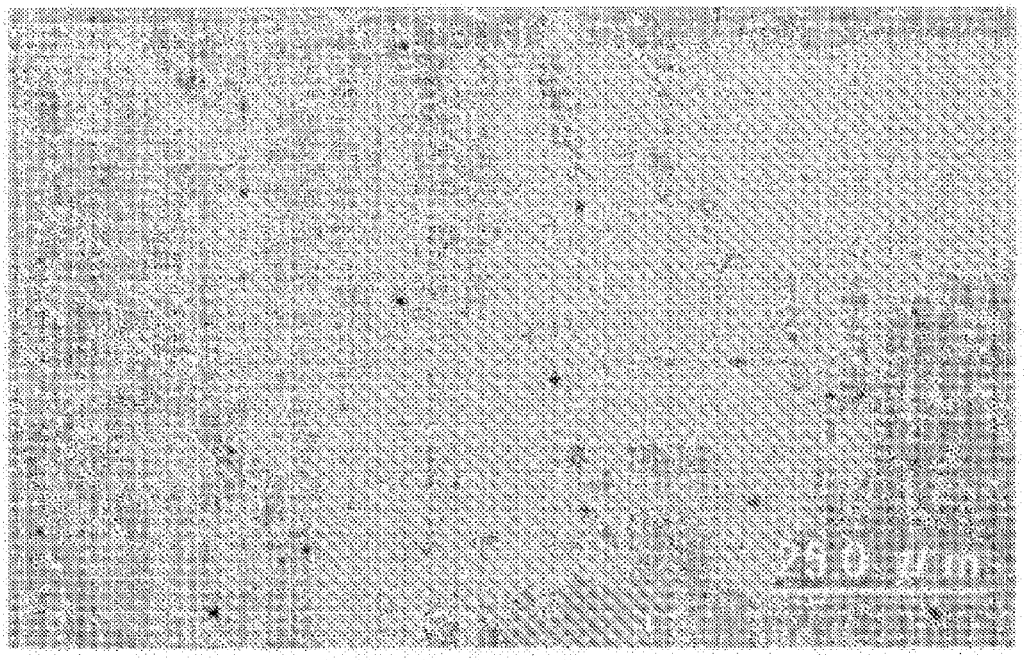
FIG. 7 each are a view showing a mode of presence of inclusions in a matrix structure.
Figure 7:
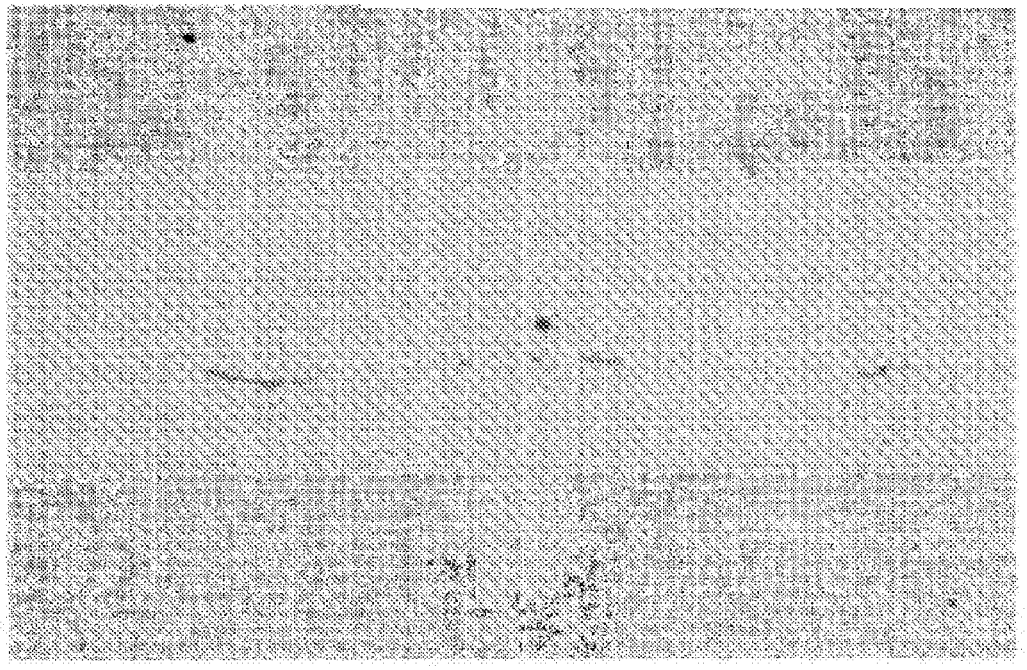

FIG. 7 show modes of presence of inclusions in a matrix structure, in the working example (Steel No. 1), and the comparative example (Steel No. 19), respectively. FIG. 7 each show the result of observation by an optical microscope, in which black parts each represent an inclusion. As is evident from FIG. 7, it can be observed that most of inclusions are found arepheroidized in the working example, whereas many inclusions are found slender in shape in the comparative example.

Working Examples of the Steel Sheet According to the Second Aspect of the Invention Respective steels, each having a specific composition shown in Table 4, were melted to be formed into an ingot 120 mm in thickness.

Further, an $Ac_1$ point, an $Ac_3$ point, an Ms point, and so forth as well as the composition are listed in Table 4. Those points are found by expressions (10) to (12), respectively, as follows.

$$Ac_1(°\,C.)=723+29.1\cdot[Si]-10.7\cdot[Mn]+16.9\cdot[Cr]-16.9[Ni] \quad \text{expression (10)}$$

$$Ac_3(°\,C.)=910-203\cdot\sqrt{[C]}-15.2\cdot[Ni]+44.7\cdot[Si]+31.5\cdot[Mo]-330\cdot[Mn]+11\cdot[Cr]+20\cdot[Cu]-720\cdot[P]-400[Al] \quad \text{expression (11)}$$

$$Ms(°\,C.)=550-361\cdot[C]-39\cdot[Mn]-20\cdot[Cr]-17\cdot[Ni]-10\cdot[Cu]-5\cdot[Mo]+30\cdot[Al] \quad \text{expression (12)}$$

where [C], [Ni], [Si], [Mo], [Mn], [Cr], [Cu], [P], and [Al] indicate contents (mass %) of elements C, Ni, Si, Mo, Mn, Cr, Cu, P, and Al, respectively.

The ingot was hot rolled to a thickness 25 mm to be hot rolled again to a thickness 3.2 mm. A workpiece was pickled to be subsequently cold rolled to a thickness 1.6 mm, thereby obtaining a steel sheet serving as a specimen. Heat treatments under various conditions shown in Table 4 were applied to the respective steel sheets.

TABLE 4

| Steel | Component (mass %) | | | | | | | | | | | | | Ac1 | Ac3 | (Ac1 + Ac3)/2 | 0.3Ac1 + 0.7Ac3 | |
|---|---|---|---|---|---|---|---|---|---|---|---|---|---|---|---|---|---|---|
| type | C | Si | Mn | P | S | Al | N | Cr | Mo | Cu | Ni | Ca | Mg | (° C.) | (° C.) | (° C.) | (° C.) | Ms (° C.) |
| $A_2$ | 0.17 | 1.36 | 2.00 | 0.012 | 0.001 | 0.044 | 0.0028 | 0.037 | — | — | — | — | — | 742 | 836 | 789 | 808 | 411 |
| $B_2$ | 0.13 | 1.35 | 2.01 | 0.014 | 0.001 | 0.044 | 0.0028 | 0.035 | — | — | — | — | — | 742 | 846 | 794 | 815 | 425 |
| $C_2$ | 0.09 | 1.17 | 2.09 | 0.014 | 0.001 | 0.046 | 0.0028 | 0.044 | 0.2 | — | — | — | — | 736 | 854 | 795 | 819 | 436 |
| $D_2$* | 0.02* | 1.40 | 2.00 | 0.010 | 0.001 | 0.050 | 0.003 | 0.040 | — | — | — | — | — | 743 | 891 | 817 | 846 | 462 |
| $E_2$* | 0.40* | 1.40 | 2.00 | 0.010 | 0.001 | 0.050 | 0.003 | 0.040 | — | — | — | — | — | 743 | 797 | 770 | 781 | 328 |
| $F_2$* | 0.17 | 3.10* | 2.00 | 0.010 | 0.001 | 0.050 | 0.003 | 0.040 | — | — | — | — | — | 790 | 914 | 852 | 876 | 411 |
| $G_2$* | 0.17 | 1.40 | 0.05* | 0.010 | 0.001 | 0.050 | 0.003 | 0.040 | — | — | — | — | — | 764 | 901 | 832 | 860 | 487 |
| $H_2$* | 0.17 | 1.40 | 6.00* | 0.010 | 0.001 | 0.050 | 0.003 | 0.040 | — | — | — | — | — | 700 | 722 | 711 | 716 | 255 |
| $I_2$* | 0.17 | 1.40 | 2.00 | 0.110* | 0.001 | 0.050 | 0.003 | 0.040 | — | — | — | — | — | 743 | 777 | 760 | 767 | 411 |
| $J_2$* | 0.17 | 1.40 | 2.00 | 0.010 | 0.010* | 0.050 | 0.003 | 0.040 | — | — | — | — | — | 743 | 842 | 793 | 812 | 411 |
| $K_2$* | 0.17 | 1.40 | 2.00 | 0.010 | 0.001 | 0.005* | 0.003 | 0.040 | — | — | — | — | — | 743 | 826 | 785 | 801 | 410 |
| $L_2$* | 0.17 | 1.40 | 2.00 | 0.010 | 0.001 | 1.100* | 0.003 | 0.040 | — | — | — | — | — | 743 | 1262 | 1003 | 1106 | 443 |
| $M_2$* | 0.17 | 1.40 | 2.00 | 0.010 | 0.001 | 0.050 | 0.015* | 0.040 | — | — | — | — | — | 743 | 842 | 793 | 812 | 411 |
| $N_2$ | 0.17 | 1.40 | 2.00 | 0.010 | 0.001 | 0.050 | 0.003 | 0.50 | — | — | — | — | — | 751 | 847 | 799 | 818 | 402 |
| $O_2$ | 0.17 | 1.40 | 2.00 | 0.010 | 0.001 | 0.050 | 0.003 | 0.040 | 0.2 | — | — | — | — | 743 | 848 | 796 | 817 | 410 |
| $P_2$ | 0.17 | 1.40 | 2.00 | 0.010 | 0.001 | 0.050 | 0.003 | 0.040 | | 0.4 | — | — | — | 743 | 850 | 797 | 818 | 407 |

TABLE 4-continued

| Steel | Component (mass %) | | | | | | | | | | | | | Ac1 | Ac3 | (Ac1 + Ac3)/2 | 0.3Ac1 + 0.7Ac3 | |
|---|---|---|---|---|---|---|---|---|---|---|---|---|---|---|---|---|---|---|
| type | C | Si | Mn | P | S | Al | N | Cr | Mo | Cu | Ni | Ca | Mg | (° C.) | (° C.) | (° C.) | (° C.) | Ms (° C.) |
| $Q_2$ | 0.17 | 1.40 | 2.00 | 0.010 | 0.001 | 0.050 | 0.003 | 0.040 | — | — | 0.5 | — | — | 735 | 835 | 785 | 805 | 403 |
| $R_2$ | 0.17 | 1.40 | 2.00 | 0.010 | 0.001 | 0.050 | 0.003 | 0.040 | — | — | — | 0.001 | — | 743 | 842 | 793 | 812 | 411 |
| $S_2$ | 0.17 | 1.40 | 2.00 | 0.010 | 0.001 | 0.050 | 0.003 | 0.040 | — | — | — | — | 0.001 | 743 | 842 | 793 | 812 | 411 |

(*Indicating departure from the range according to the present invention.)

TABLE 5

| Heat treatment | First annealing condition | | | Second annealing condition | | | | Tempering condition | |
|---|---|---|---|---|---|---|---|---|---|
| | Heating temperature (° C.) | Retention time (s) | Cooling rate (° C./s) | Heating rate (° C./s) | Heating temperature (° C.) | Retention time (s) | Cooling rate (° C./s) | Heating temperature (° C.) | Retention time (s) |
| $a_2$ | 930 | 90 | 50 | 20 | 835 | 120 | 50 | 500 | 180 |
| $b_2$ | 930 | 90 | 50 | 20 | 820 | 120 | 50 | 500 | 180 |
| $c_2$ | 930 | 90 | 50 | 20 | 835 | 120 | 50 | 500 | 180 |
| $d_2$ | 930 | 90 | 50 | 20 | 825 | 120 | 50 | 500 | 180 |
| $e_2$ | 930 | 90 | 50 | 20 | 835 | 120 | 50 | 400 | 180 |
| $f_2$* | 930 | 90 | 50 | 20 | 780* | 120 | 50 | 500 | 180 |
| $g_2$* | 930 | 90 | 50 | 20 | 850* | 120 | 50 | 500 | 180 |
| $h_2$* | 930 | 90 | 30* | 20 | 800 | 120 | 50 | 500 | 180 |
| $i_2$* | —* | —* | 50 | 20 | 825 | 120 | 50 | 500 | 180 |
| $j_2$ | 930 | 90 | 50 | 20 | 800 | 120 | 50 | 500 | 180 |
| $k_2$ | 930 | 90 | 50 | 20 | 835 | 120 | 50 | 500 | 1000 |
| $l_2$ | 930 | 90 | 50 | 20 | 835 | 120 | 50 | 500 | 80 |
| $m_2$* | 780* | 90 | 50 | 20 | 835 | 120 | 50 | 500 | 180 |
| $n_2$* | 1030* | 90 | 50 | 20 | 835 | 120 | 50 | 500 | 180 |
| $o_2$* | 930 | 90 | 20* | 20 | 835 | 120 | 50 | 500 | 180 |
| $p_2$* | 930 | 90 | 50 | 10* | 835 | 120 | 50 | 500 | 180 |
| $q_2$* | 930 | 90 | 50 | 20 | 760* | 120 | 50 | 500 | 180 |
| $r_2$* | 930 | 90 | 50 | 20 | 850* | 120 | 50 | 500 | 180 |
| $s_2$* | 930 | 90 | 50 | 20 | 835 | 900* | 50 | 500 | 180 |
| $t_2$* | 930 | 90 | 50 | 20 | 835 | 120 | 30* | 500 | 180 |
| $u_2$* | 930 | 90 | 50 | 20 | 835 | 120 | 50 | 280* | 180 |
| $v_2$* | 930 | 90 | 50 | 20 | 835 | 120 | 50 | 570* | 180 |

(*Indicating departure from the recommended range according to the present invention.)

According to the respective measuring methods described under the heading [BEST MODE FOR CARRYING OUT THE INVENTION], measurements for the area ratio of tempered martensite, the hardness thereof, the maximum diameter of a ferrite grain, and orientation of ferrite grains were made on the respective steel sheets with the heat treatment applied thereto.

Further, measurements for tensile strength TS, elongation El, and stretch flangeability λ, respectively, were made on the respective steel sheets. A test piece referred to as No. 5 test piece in JIS Z 2201, with its long axis oriented in a direction at right angles to a rolling direction, was prepared, and measurements for tensile strength TS, and elongation El, respectively, in accordance with JIS Z 2241, were made on the test piece. Further, stretch flangeability λ were found by conducting a hole expanding test according to Iron and Steel Federation specification JFST 1001, whereby a hole expanding ratio was measured. Tables 6, and 7 each show results of those measurements.

TABLE 6

| Steel No. | Steel type | Heat treatment | Tempered martensite hardness (Hv) | Tempered martensite area ratio (%) | Ferrite area ratio (%) | Other structure area ratio (%) | The max diameter of ferrite particle, as the diameter of equivalent circle (μm) | Frequency distribution of angles formed between the C-direction and the longitudinal direction of ferrite particle, varying in increments of 10-degrees (%) Maximum value | Minimum value | TS (MPa) | EL (%) | λ (%) | De-termination |
|---|---|---|---|---|---|---|---|---|---|---|---|---|---|
| 30 | $A_2$ | $a_2$ | 366 | 68 | 32 | 0 | 10.8 | 15.6 | 7.3 | 1007 | 15.4 | 109.6 | ◎ |
| 31 | $A_2$ | $b_2$ | 371 | 59 | 41 | 0 | 11.8 | 12.8 | 8.5 | 985 | 15.0 | 93.7 | ○ |
| 32 | $B_2$ | $c_2$ | 375 | 57 | 43 | 0 | 11.7 | 15.8 | 7.1 | 984 | 14.8 | 99.2 | ○ |
| 33 | $C_2$ | $d_2$ | 323* | 57 | 43 | 0 | 7.6 | 15.3 | 6.2 | 879 | 15.4 | 101.2 | X |
| 34 | $B_2$ | $e_2$ | 539* | 57 | 43 | 0 | 11.7 | 15.8 | 7.1 | 1170 | 8.9 | 52.8 | X |

TABLE 6-continued

| Steel No. | Steel type | Heat treatment | Tempered martensite hardness (Hv) | Tempered martensite area ratio (%) | Ferrite area ratio (%) | Other structure area ratio (%) | The max diameter of ferrite particle, as the diameter of equivalent circle (μm) | Frequency distribution of angles formed between the C-direction and the longitudinal direction of ferrite particle, varying in increments of 10-degrees (%) Maximum value | Minimum value | TS (MPa) | EL (%) | λ (%) | De-termination |
|---|---|---|---|---|---|---|---|---|---|---|---|---|---|
| 35 | $A_2$ | $f_2$ | 435 | 42* | 58 | 0 | 13.0* | 15.9 | 6.4 | 961 | 18.4 | 88.7 | X |
| 36 | $A_2$ | $g_2$ | 350 | 90* | 10 | 0 | 10.2 | 20.3* | 5.6* | 1004 | 11.4 | 89.5 | X |
| 37 | $A_2$ | $h_2$ | 411 | 60 | 40 | 0 | 16.5* | 14.9 | 7.4 | 992 | 13.3 | 59.5 | X |
| 38 | $A_2$ | $i_2$ | 451* | 62 | 38 | 0 | 10.2 | 21.6* | 5.5* | 1071 | 12.0 | 84.0 | X |
| 39 | $D_2$* | $j_2$ | 419 | 30* | 70 | 0 | 13.8* | 16.0 | 7.7 | 762 | 18.6 | 47.2 | X |
| 40 | $E_2$* | $j_2$ | 633* | 100* | 0 | 0 | n.m.* | n.m.* | n.m.* | 1452 | 10.2 | 60.8 | X |
| 41 | $F_2$* | $j_2$ | 437 | 38* | 62 | 0 | 13.2* | 13.6 | 8.7 | 961 | 17.6 | 55.5 | X |
| 42 | $G_2$* | $j_2$ | 413 | 33* | 67 | 0 | 13.6* | 15.0 | 8.2 | 738 | 18.2 | 50.3 | X |
| 43 | $H_2$* | $j_2$ | 410 | 85* | 0 | 15 | n.m.* | n.m.* | n.m.* | 1179 | 8.3 | 46.7 | X |
| 44 | $I_2$* | $j_2$ | 424 | 52 | 48 | 0 | 12.3* | 12.9 | 9.0 | 980 | 16.0 | 65.4 | X |
| 45 | $J_2$* | $j_2$ | 418 | 60 | 40 | 0 | 11.7 | 13.2 | 8.9 | 1007 | 15.0 | 51.3 | X |
| 46 | $K_2$* | $j_2$ | 418 | 59 | 41 | 0 | 11.8 | 13.0 | 9.0 | 998 | 7.9 | 66.1 | X |
| 47 | $L_2$* | $j_2$ | 419 | 34* | 66 | 0 | 11.6 | 14.7 | 8.3 | 794 | 18.1 | 51.4 | X |
| 48 | $M_2$* | $j_2$ | 421 | 62 | 38 | 0 | 11.5 | 13.6 | 8.7 | 1041 | 6.5 | 60.8 | X |
| 49 | $N_2$ | $j_2$ | 408 | 59 | 41 | 0 | 11.3 | 14.4 | 8.4 | 1003 | 14.4 | 95.6 | ○ |
| 50 | $O_2$ | $j_2$ | 419 | 57 | 43 | 0 | 11.9 | 12.8 | 9.1 | 1012 | 15.4 | 93.2 | ○ |
| 51 | $P_2$ | $j_2$ | 425 | 60 | 40 | 0 | 11.7 | 13.9 | 8.2 | 1021 | 15.0 | 95.3 | ○ |
| 52 | $Q_2$ | $j_2$ | 418 | 55 | 45 | 0 | 12.0 | 12.7 | 9.1 | 1006 | 15.6 | 93.9 | ○ |
| 53 | $R_2$ | $j_2$ | 418 | 60 | 40 | 0 | 11.7 | 13.2 | 8.9 | 1007 | 15.0 | 98.2 | ○ |
| 54 | $S_2$ | $j_2$ | 418 | 60 | 40 | 0 | 11.7 | 13.2 | 8.9 | 1007 | 15.0 | 98.2 | ○ |
| 55 | $A_2$ | $k_2$ | 351 | 60 | 40 | 0 | 11.7 | 13.9 | 8.2 | 980 | 15.6 | 92.8 | ○ |
| 56 | $A_2$ | $l_2$ | 439 | 60 | 40 | 0 | 11.7 | 13.9 | 8.2 | 1055 | 14.3 | 97.8 | ○ |
| 57 | $A_2$ | $m_2$ | 410 | 60 | 40 | 0 | 14.3* | 24.1* | 3.9* | 999 | 11.6 | 77.5 | X |
| 58 | $A_2$ | $n_2$ | 384 | 60 | 40 | 0 | 25.0* | 13.2 | 8.9 | 940 | 14.7 | 75.0 | X |
| 59 | $A_2$ | $o_2$ | 398 | 60 | 40 | 0 | 15.0* | 15.6 | 7.3 | 966 | 14.7 | 56.8 | X |
| 60 | $A_2$ | $p_2$ | 405 | 60 | 40 | 0 | 11.7 | 21.5* | 5.3* | 980 | 12.0 | 83.0 | X |
| 61 | $A_2$ | $q_2$ | 456* | 40* | 60 | 0 | 23.8* | 24.2* | 3.7* | 890 | 17.0 | 60.0 | X |
| 62 | $A_2$ | $r_2$ | 332 | 90* | 10 | 0 | 10.2 | 20.3* | 5.6* | 1004 | 11.4 | 61.8 | X |
| 63 | $A_2$ | $s_2$ | 415 | 60 | 40 | 0 | 11.8 | 21.6* | 5.5* | 1000 | 12.0 | 83.0 | X |
| 64 | $A_2$ | $t_2$ | 446 | 40* | 60 | 0 | 21.9* | 23.7* | 4.1* | 877 | 16.4 | 66.7 | X |
| 65 | $A_2$ | $u_2$ | 504* | 60 | 40 | 0 | 11.7 | 15.8 | 7.1 | 1170 | 8.9 | 52.8 | X |
| 66 | $A_2$ | $v_2$ | 310* | 60 | 40 | 0 | 7.6 | 15.4 | 7.5 | 799 | 21.4 | 95.2 | X |

(*Indicating departure from the range according to the present invention. n.m.: not measurable Evaluation (rating) ◎: TS ≧ 980 MPa, EI ≧ 13%, λ ≧ 100%, ○: TS ≧ 980 MPa, EI ≧ 13%, λ ≧ 90%, X: TS < 980 MPa or EI < 13% or λ < 90%)

As shown in Tables 6, and 7, the working examples, Steel Nos. 30 to 32, and 49 to 56, each were found having tensile strength TS at 980 MPa or higher, elongation El at 13% or more, and stretch flangeability (a hole expanding ratio) λ at 90% or more. That is, there was obtained a high-strength cold-rolled steel sheet having both elongation, and stretch flangeability, meeting required levels described in the paragraph under the heading BACKGROUND TECHNOLOGY.

In contrast, the comparative examples, Steel Nos. 33 to 48, and 57 to 66, each were found inferior in any of mechanical characteristics.

For example, Steel No. 33 had an area ratio of tempered martensite, in a range of 50 to 70%, and was found excellent in elongation, and stretch flangeability, however, it was found inferior in tensile strength because its hardness was excessively low.

Meanwhile, with Steel No. 34, an area ratio of tempered martensite was in a range of 50 to 70%, and it was found excellent in tensile strength, however, it was found inferior in elongation, and stretch flangeability because its hardness was excessively high.

Further, with Steel No. 35, an area ratio of tempered martensite was less than 50, so that it was found excellent in elongation, and stretch flangeability, but found inferior in tensile strength.

Meanwhile, with Steel No. 36, an area ratio of tempered martensite was in excess of 70%, so that it was found excellent in tensile strength, and stretch flangeability, but found inferior in elongation.

Further, with Steel No. 37, an area ratio of tempered martensite was in a range of 50 to 70%, and hardness of the tempered martensite was in a range of range of 330 to 450 Hv, however, the max. grain size of a ferrite grain, as the diameter of an equivalent circle, was in excess of 12 μm. For this reason, with Steel No. 37, the area ratio of the tempered martensite turned to less than 50%, and it was found inferior in stretch flangeability although it was excellent in tensile strength, and elongation.

Further, with Steel No. 38, an area ratio of tempered martensite was in a range of 50 to 70%, hardness of the tempered martensite was in a range of 330 to 450 Hv, and the maximum grain size of a ferrite grain as the diameter of an equivalent circle, was less than 12 μm, however, frequency distribution of angles formed between C-direction and the longitudinal direction of a ferrite grain, varying in increments of 10-degrees, failed to fall in the range as set out. For this reason, with Steel No. 38, tensile strength TS, 980 MPa or higher, was achieved, however, required levels were not attained with respect to elongation, and stretch flangeability.

Further, with Steel No. 39, C-content was excessively low, so that an area ratio of its tempered martensite was insufficient, although hardness of the tempered martensite was in a range of range of 330 to 450 Hv. For this reason, Steel No. 39 was found excellent in elongation but found inferior in tensile strength and stretch flangeability.

Meanwhile, with Steel No. 40, C-content was excessively high, and hardness of the tempered martensite was excessively high, so that it was found excellent in tensile strength, but found inferior in both elongation, and stretch flangeability.

Further, with Steel No. 41, Si-content was excessively high, so that formation of austenite at the time of heating was blocked, resulting in insufficiency in the area ratio of martensite. For this reason, Steel No. 41 was found excellent in tensile strength and elongation, but found inferior in stretch flangeability.

Further, with Steel No. 42, Mn-content was excessively low, so that it was impossible to secure hardenability, and insufficiency resulted in an area ratio of martensite formed at the time of quenching (upon cooling after heating for annealing). For this reason, Steel No. 42 was found excellent in elongation, but found inferior in tensile strength, and stretch flangeability.

On the other hand, with Steel No. 43, Mn-content was excessively high, so that residual austenite remained at the time of hardening, that is, quenching (upon cooling after heating for annealing), and Steel No. 43 was therefore found excellent in tensile strength, and elongation, but found inferior in stretch flangeability.

Further, with Steel Nos. 57 to 66, at least one of requirements for controlling the structure according to the present invention was not satisfied because of departure of the annealing condition, or the tempering condition from the range recommended by the second aspect of the present invention, so that Steel Nos. 57 to 66 each were found inferior in at least one of tensile strength, elongation, and stretch flangeability.

Figure 8:
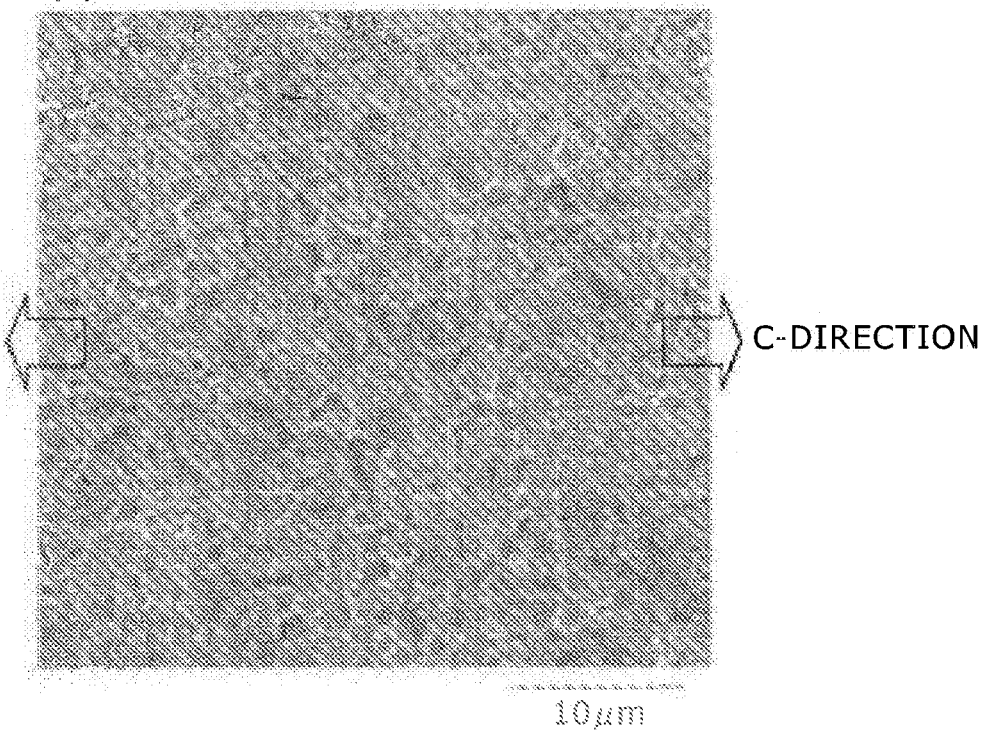
FIG. 8 each are a view showing a distribution state of ferrite phases and martensite phases in the structure, in which FIG. 8(*a*) represents the case of the working example, and FIG. 8(*b*) represents the case of the comparative example.
Figure 8:
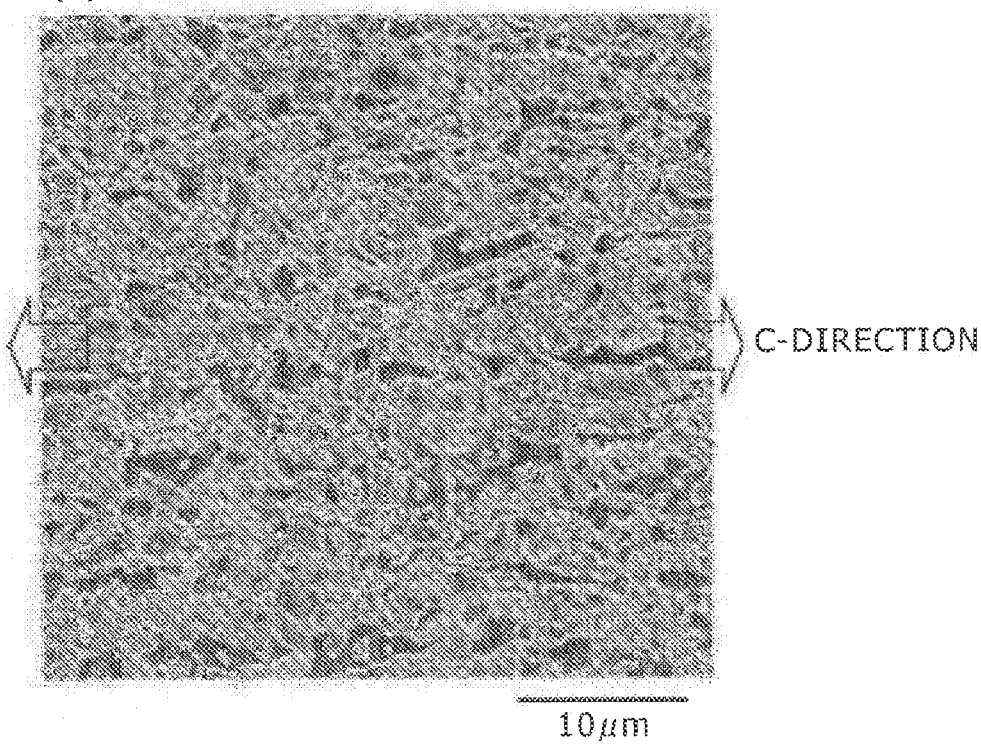
Figure 9:
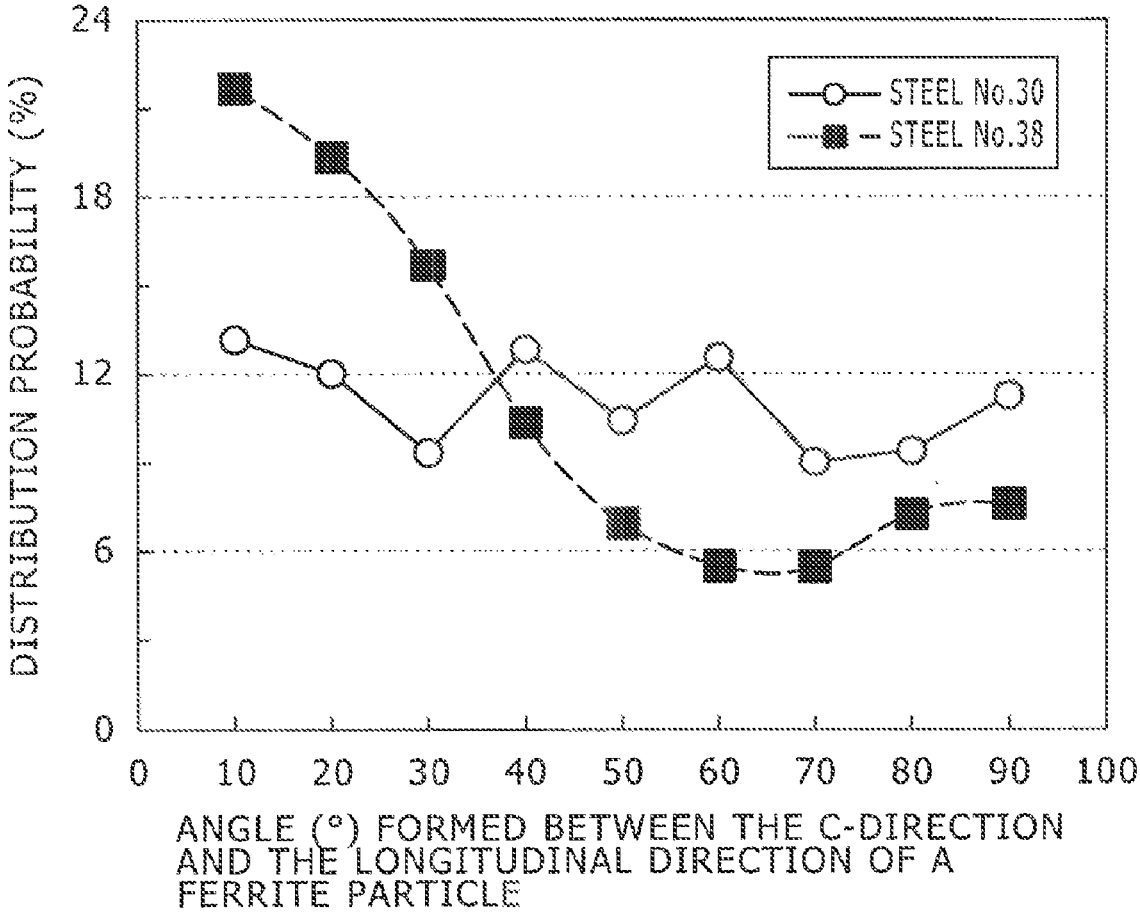
FIG. 9 is a graph showing frequency distribution of angles formed between the C-direction and the longitudinal direction of a ferrite grain, varying in increments of 10-degrees.

FIG. 8 show distribution states of ferrite phases and martensite phases in the structure of the working example (Steel No. 30), and the comparative example (Steel No. 38), respectively, by way of example. FIG. 8 each show the result of observation by an SEM, in which regions containing a white granular contrast are the martensite phases, and the rest of the structure are regions representing the ferrite phases. In FIG. 9, there is shown frequency distribution of angles formed between the C-direction and the longitudinal direction of a ferrite grain, varying in increments of 10-degrees. In the figure, distribution probability of the angle falling in a range of, for example, 0 to 10° is plotted so as to correspond to the spot of 10° on the horizontal axis. It is evident from these figures that the structure of the working example (Steel No. 30) is more isotropic in respect of orientation of ferrite articles in relation to the C-direction than the structure of the comparative example (Steel No. 38).

Working Examples of the Steel Sheet According to the Third Aspect of the Invention Respective steels, each having a specific composition shown in Table 8, were melted to be formed into an ingot 120 mm in thickness. The ingot was hot rolled to a thickness 25 mm to be hot rolled again to a thickness 3.2 mm. A workpiece was pickled to be subsequently cold rolled to a thickness 1.6 mm, thereby obtaining a steel sheet serving as a specimen. Heat treatments under various conditions shown in Table 9 were applied to the steel sheet.

TABLE 8

| Steel | Component (mass %) | | | | | | | | | | | | | (Ac1 + Ac3)/2 |
|---|---|---|---|---|---|---|---|---|---|---|---|---|---|---|
| type | C | Si | Mn | P | S | N | Al | Cr | Mo | Cu | Ni | Ca | Mg | (° C.) |
| $A_3$ | 0.15 | 1.21 | 2.04 | 0.001 | 0.002 | 0.004 | 0.031 | — | — | — | — | — | — | 811 |
| $B_3$ | 0.16 | 1.22 | 2.01 | 0.001 | 0.002 | 0.004 | 0.030 | — | — | — | — | 0.0010 | — | 810 |
| $C_3$ | 0.02* | 1.22 | 2.03 | 0.001 | 0.002 | 0.004 | 0.031 | — | — | — | — | 0.0010 | — | 836 |
| $D_3$ | 0.26 | 1.21 | 2.08 | 0.001 | 0.002 | 0.004 | 0.031 | — | — | — | — | 0.0010 | — | 798 |
| $E_3$ | 0.41* | 1.21 | 2.10 | 0.001 | 0.002 | 0.004 | 0.031 | — | — | — | — | 0.0010 | — | 785 |
| $F_3$ | 0.16 | 0.10 | 2.09 | 0.001 | 0.002 | 0.004 | 0.031 | — | — | — | — | 0.0010 | — | 768 |
| $G_3$ | 0.16 | 1.86 | 2.04 | 0.001 | 0.002 | 0.004 | 0.031 | — | — | — | — | 0.0010 | — | 834 |
| $H_3$ | 0.15 | 3.02* | 2.02 | 0.001 | 0.002 | 0.004 | 0.030 | — | — | — | — | 0.0010 | — | 878 |
| $I_3$ | 0.15 | 1.22 | 0.05* | 0.001 | 0.002 | 0.004 | 0.030 | — | — | — | — | 0.0010 | — | 822 |
| $J_3$ | 0.15 | 1.20 | 1.23 | 0.001 | 0.002 | 0.004 | 0.031 | — | — | — | — | 0.0010 | — | 815 |
| $K_3$ | 0.15 | 1.22 | 3.01 | 0.001 | 0.002 | 0.004 | 0.030 | — | — | — | — | 0.0010 | — | 806 |
| $L_3$ | 0.15 | 1.21 | 6.02* | 0.001 | 0.002 | 0.004 | 0.030 | — | — | — | — | 0.0010 | — | 790 |
| $M_3$ | 0.15 | 1.24 | 2.05 | 0.001 | 0.002 | 0.004 | 0.031 | 0.50 | — | — | — | 0.0010 | — | 816 |
| $N_3$ | 0.16 | 1.23 | 2.04 | 0.001 | 0.002 | 0.004 | 0.031 | — | 0.20 | — | — | 0.0010 | — | 814 |
| $O_3$ | 0.15 | 1.24 | 2.07 | 0.001 | 0.002 | 0.004 | 0.030 | — | — | 0.40 | — | 0.0010 | — | 812 |
| $P_3$ | 0.15 | 1.22 | 2.06 | 0.001 | 0.002 | 0.004 | 0.031 | — | — | — | 0.50 | 0.0010 | — | 803 |
| $Q_3$ | 0.16 | 1.24 | 2.10 | 0.001 | 0.002 | 0.004 | 0.031 | — | — | — | — | — | 0.0010 | 810 |

(*Indicating departure from the range according to the present invention.)

TABLE 9

| | Annealing condition | | | | | | Tempering condition | |
|---|---|---|---|---|---|---|---|---|
| Heat treatment | Heating temperature (° C.) | Retention time (s) | First cooling rate (° C./s) | First cooling completion temperature (° C.) | Second cooling rate (° C./s) | Second cooling completion temperature (° C.) | Heating temperature (° C.) | Retention time (s) |
| $a_3$ | 900 | 120 | 20 | 675 | 200 | 20 | 600 | 15 |
| $b_3$ | 900 | 120 | 20 | 675 | 200 | 20 | 500* | 180* |
| $c_3$ | 900 | 120 | 20 | 675 | 200 | 20 | 600 | 1* |

TABLE 9-continued

| Heat treatment | Annealing condition: Heating temperature (° C.) | Retention time (s) | First cooling rate (° C./s) | First cooling completion temperature (° C.) | Second cooling rate (° C./s) | Second cooling completion temperature (° C.) | Tempering condition: Heating temperature (° C.) | Retention time (s) |
|---|---|---|---|---|---|---|---|---|
| $d_3$ | 900 | 120 | 20 | 675 | 200 | 20 | 600 | 180* |
| $e_3$ | 900 | 120 | 20 | 675 | 200 | 20 | 700* | 15 |
| $f_3$ | 900 | 120 | 20 | 580* | 200 | 20 | 600 | 15 |
| $g_3$ | 800* | 120 | 20 | 675 | 200 | 20 | 600 | 15 |
| $h_3$ | 900 | 120 | 20 | 700 | 200 | 20 | 550 | 15 |

(*Indicating departure from the recommended range according to the present invention.)

In accordance with the respective measuring methods described under the heading [BEST MODE FOR CARRYING OUT THE INVENTION], measurements for the area ratio of tempered martensite, the hardness thereof, and dislocation density were made on the respective steel sheets with the heat treatment applied thereto.

Further, measurements for yield strength YP, elongation El, and stretch flangeability λ, respectively, were made on the respective steel sheets. A test piece referred to as No. 5 test piece in JIS Z 2201, with its long axis oriented in a direction at right angles to a rolling direction, was prepared, and measurements for yield strength YP, and elongation El, respectively, were made on the test piece in accordance with JIS Z 2241. Further, stretch flangeability λ was found by conducting a hole expanding test according to Iron and Steel Federation specification JFST 1001, thereby measuring a hole expanding ratio.

Table 3 shows results of those measurements.

Table 10 shows the results of those measurements,

TABLE 10

| Steel No. | Steel type | Heat treatment | Tempered martensite area ratio VM (%) | Ferrite area ratio VF (%) | Other structure area ratio (%) | Tempered martensite hardness HvM | Vickers hardness Hv | Ferrite hardness HvF |
|---|---|---|---|---|---|---|---|---|
| 67 | $A_3$ | $a_3$ | 85 | 15 | 0 | 358 | 328 | 160 |
| 68 | $B_3$ | $a_3$ | 85 | 15 | 0 | 368 | 337 | 160 |
| 69 | $C_3$ | $a_3$ | 30* | 70 | 0 | 301 | 202 | 160 |
| 70 | $D_3$ | $a_3$ | 100 | 0 | 0 | 351 | 351 | 161 |
| 71 | $E_3$ | $a_3$ | 100 | 0 | 0 | 411* | 411 | 161 |
| 72 | $F_3$ | $a_3$ | 95 | 5 | 0 | 313 | 304 | 131 |
| 73 | $G_3$ | $a_3$ | 80 | 20 | 0 | 375 | 336 | 178 |
| 74 | $H_3$ | $a_3$ | 25* | 75 | 0 | 621* | 312 | 209 |
| 75 | $I_3$ | $a_3$ | 40* | 60 | 0 | 333 | 218 | 141 |
| 76 | $J_3$ | $a_3$ | 80 | 20 | 0 | 342 | 304 | 152 |
| 77 | $K_3$ | $a_3$ | 95 | 5 | 0 | 378 | 368 | 170 |
| 78 | $L_3$ | $a_3$ | 80 | 0 | 20 | n.m. | 405 | n.m. |
| 79 | $M_3$ | $a_3$ | 90 | 10 | 0 | 373 | 351 | 156 |
| 80 | $N_3$ | $a_3$ | 90 | 10 | 0 | 372 | 351 | 162 |
| 81 | $O_3$ | $a_3$ | 90 | 10 | 0 | 371 | 350 | 166 |
| 82 | $P_3$ | $a_3$ | 95 | 5 | 0 | 351 | 341 | 161 |
| 83 | $Q_3$ | $a_3$ | 95 | 5 | 0 | 346 | 337 | 162 |
| 84 | $B_3$ | $b_3$ | 85 | 15 | 0 | 361 | 331 | 160 |
| 85 | $B_3$ | $c_3$ | 85 | 15 | 0 | 414* | 376 | 160 |
| 86 | $B_3$ | $d_3$ | 85 | 15 | 0 | 313 | 290 | 160 |
| 87 | $B_3$ | $e_3$ | 85 | 15 | 0 | 293 | 273 | 160 |
| 88 | $B_3$ | $f_3$ | 35* | 65 | 0 | 476* | 271 | 160 |
| 89 | $B_3$ | $g_3$ | 40* | 60 | 0 | 484* | 290 | 160 |
| 90 | $B_3$ | $h_3$ | 100 | 0 | 0 | 377 | 377 | — |

| Steel No. | Dislocation density ρ ($10^{15}$ $m^{-2}$) | Si equivalent (mass %) | $4.0-\sqrt{\rho}$ ($m^{-1}$) | YP (MPa) | El (%) | λ (%) | Remarks |
|---|---|---|---|---|---|---|---|
| 67 | 1.8 | 2.0 | 1.7 | 981 | 12.2 | 104 | Working example |
| 68 | 1.9 | 2.0 | 1.7 | 983 | 12.1 | 114 | Working example |
| 69 | 0.7* | 2.0* | 2.6 | 581* | 18.9 | 42* | Comparative example* |
| 70 | 2.2 | 2.0 | 1.5 | 1052 | 10.8 | 123 | Working example |
| 71 | 2.1 | 2.0 | 1.6 | 1234 | 6.3* | 53* | Comparative example* |
| 72 | 2.1 | 0.9* | 1.6 | 911 | 12.1 | 103 | Comparative example* |
| 73 | 1.7 | 2.6 | 1.8 | 1007 | 12.4 | 102 | Working example |
| 74 | 0.6* | 3.8 | 2.7 | 860* | 6.1* | 78* | Comparative example* |
| 75 | 0.8* | 1.2 | 2.5 | 653* | 11.2 | 75* | Comparative example* |
| 76 | 2.3 | 1.7 | 1.5 | 913 | 13.5 | 107 | Working example |
| 77 | 2.0 | 2.3 | 1.6 | 1182 | 10.3 | 103 | Working example |
| 78 | 1.8 | 3.4 | 1.8 | 1215 | 4.9* | 18* | Comparative example* |
| 79 | 1.9 | 2.2 | 1.7 | 1054 | 11.5 | 121 | Working example |

TABLE 10-continued

| | | | | | | | |
|---|---|---|---|---|---|---|---|
| 80 | 1.8 | 2.0 | 1.7 | 1054 | 11.4 | 121 | Working example |
| 81 | 2.0 | 2.2 | 1.6 | 1050 | 11.1 | 123 | Working example |
| 82 | 1.9 | 2.0 | 1.7 | 1023 | 11.4 | 124 | Working example |
| 83 | 2.0 | 2.0 | 1.7 | 1011 | 11.0 | 120 | Working example |
| 84 | 0.8* | 2.0* | 2.5 | 882* | 12.5 | 112 | Comparative example* |
| 85 | 4.3* | 2.0 | 0.5 | 1122 | 7.6* | 16* | Comparative example* |
| 86 | 0.5* | 2.0* | 2.8 | 861* | 11.3 | 114 | Comparative example* |
| 87 | 0.2* | 2.0* | 3.3 | 772* | 13.8 | 103 | Comparative example* |
| 88 | 1.1 | 2.0* | 2.2 | 836* | 15.4 | 77* | Comparative example* |
| 89 | 1.2 | 2.0* | 2.2 | 858* | 16.7 | 72* | Comparative example* |
| 90 | 3.0 | 2.0 | 2.3 | 1191 | 10.1 | 101 | Working example |

(*Indicating departure from the range according to the present invention. n.m.: not measurable)

As shown in Table 10, the working examples, Steel Nos. 67, 68, 70, 73, 76, 77, 79 to 83, and 90 each were found having yield strength (YP) at 900 MPa or higher, elongation (El) at 10% or more, and stretch flangeability (a hole expanding ratio) λ at 100% or more. Accordingly, with those working examples, there was obtained a high-strength cold-rolled steel sheet having both yield strength, and elongation as well as stretch flangeability, satisfying the required levels described in the paragraph under the heading BACKGROUND TECHNOLOGY.

In contrast, the comparative examples, Steel Nos. 69, 71, 72, 74, 75, 78, and 84 to 89, each were found inferior in any of characteristics.

For example, with Steel No. 69, C-content was excessively low, so that an area ratio of its tempered martensite at 50% or less was insufficient, and furthermore, dislocation density, and an Si equivalent were also insufficient. For this reason, Steel No. 69 was found excellent in elongation, but was found inferior in yield strength and stretch flangeability.

Further, with Steel No. 71, C-content was excessively high, and an area ratio of its tempered martensite at 50% or more was secured, however, the hardness of the tempered martensite is too high, so that Steel No. 71 was found excellent in yield strength, but found inferior in elongation, and stretch flangeability.

Further, with Steel No. 74, since Si-content was excessively high, an area ratio of its tempered martensite was insufficient, the hardness of the tempered martensite was too high, and in addition, dislocation density was insufficient, so that Steel No. 74 was found inferior in any of yield strength, elongation, and stretch flangeability.

Further, with Steel No. 75, since Mn-content was excessively low, an area ratio of its tempered martensite was insufficient, and in addition, dislocation density as well was insufficient, so that No. 75 was found excellent elongation, but was found inferior in yield strength, and stretch flangeability.

Further, with Steel No. 78, since Mn-content was excessively high, residual austenite remained at the time of hardening, (upon cooling after heating for annealing), so that Steel No. 78 was found excellent in yield strength, but found inferior in elongation, and stretch flangeability.

Further, with Steel Nos. 84 to 89, at least one of requirements for controlling the structure according to the third aspect of the present invention was not satisfied because of departure of the annealing condition, or the tempering condition from the range recommended by the third aspect of the present invention, so that Steel Nos. 84 to 89 each were found inferior in at least one of yield strength, elongation, and stretch flangeability.

Working Examples of the Steel Sheet According to the Fourth Aspect of the Invention Respective steels, each having a specific composition shown in Table 11, were melted to be formed into an ingot 120 mm in thickness. The ingot was hot rolled to a thickness 25 mm to be hot rolled again to a thickness 3.2 mm. A workpiece was pickled to be subsequently cold rolled to a thickness 1.6 mm, thereby obtaining a steel sheet serving as a specimen. Heat treatments under various conditions shown in Table 12 were applied to the steel sheet.

TABLE 11

| Steel | Component (mass %) | | | | | | | | | | | | | | Ac1 | Ac3 | 0.3Ac1 + 0.7Ac3 | f |
|---|---|---|---|---|---|---|---|---|---|---|---|---|---|---|---|---|---|---|
| type | C | Si | Mn | P | S | N | Al | Cr | Mo | Cu | Ni | Ca | Mg | Others | (° C.) | (° C.) | (° C.) | (%) |
| $A_4$ | 0.16 | 1.21 | 1.50 | 0.001 | 0.002 | 0.004 | 0.031 | 1.03 | — | — | — | — | — | — | 760 | 883 | 846 | 0.024 |
| $B_4$ | 0.15 | 1.21 | 1.54 | 0.001 | 0.002 | 0.004 | 0.030 | 0.00* | — | — | — | — | — | — | 742 | 885 | 842 | 0.022 |
| $C_4$ | 0.15 | 1.20 | 1.53 | 0.001 | 0.005 | 0.004 | 0.031 | 0.55 | — | — | — | 0.0010 | — | — | 751 | 885 | 845 | 0.022 |
| $D_4$ | 0.16 | 0.62 | 1.62 | 0.001 | 0.002 | 0.004 | 0.031 | 1.04 | — | — | — | 0.0010 | — | — | 741 | 857 | 822 | 0.024 |
| $E_4$ | 0.15 | 1.23 | 1.22 | 0.001 | 0.002 | 0.004 | 0.030 | 1.36 | — | — | — | 0.0010 | — | — | 769 | 886 | 851 | 0.022 |
| $F_4$ | 0.12 | 0.00 | 1.54 | 0.001 | 0.002 | 0.004 | 0.031 | 2.20 | — | — | — | 0.0010 | — | — | 744 | 840 | 811 | 0.018 |
| $G_4$ | 0.13 | 0.02 | 1.47 | 0.001 | 0.002 | 0.004 | 0.031 | 5.21* | — | — | — | 0.0010 | — | — | 796 | 838 | 825 | 0.019 |
| $H_4$ | 0.01* | 1.25 | 1.53 | 0.001 | 0.002 | 0.004 | 0.031 | 1.01 | — | — | — | 0.0010 | — | — | 760 | 946 | 890 | 0.001 |
| $I_4$ | 0.11 | 1.23 | 1.50 | 0.001 | 0.002 | 0.004 | 0.031 | 1.01 | — | — | — | 0.0010 | — | — | 760 | 898 | 856 | 0.016 |
| $J_4$ | 0.25 | 1.20 | 1.56 | 0.001 | 0.002 | 0.004 | 0.030 | 1.03 | — | — | — | 0.0010 | — | — | 759 | 862 | 831 | 0.037 |
| $K_4$ | 0.35* | 0.10 | 1.51 | 0.001 | 0.002 | 0.004 | 0.031 | 1.04 | — | — | — | 0.0010 | — | — | 727 | 794 | 774 | 0.052 |
| $L_4$ | 0.15 | 1.82 | 1.53 | 0.001 | 0.002 | 0.004 | 0.031 | 1.01 | — | — | — | 0.0010 | — | — | 777 | 913 | 872 | 0.022 |
| $M_4$ | 0.16 | 3.13* | 1.55 | 0.001 | 0.002 | 0.004 | 0.030 | 1.02 | — | — | — | 0.0010 | — | — | 815 | 969 | 923 | 0.024 |
| $N_4$ | 0.15 | 1.20 | 0.05* | 0.001 | 0.002 | 0.004 | 0.031 | 1.01 | — | — | — | 0.0010 | — | — | 774 | 885 | 852 | 0.022 |
| $O_4$ | 0.15 | 1.21 | 1.24 | 0.001 | 0.002 | 0.004 | 0.031 | 1.04 | — | — | — | 0.0010 | — | — | 763 | 885 | 849 | 0.022 |
| $P_4$ | 0.16 | 1.21 | 3.13 | 0.001 | 0.002 | 0.004 | 0.031 | 1.05 | — | — | — | 0.0010 | — | — | 742 | 883 | 841 | 0.024 |
| $Q_4$ | 0.15 | 1.23 | 6.11* | 0.001 | 0.002 | 0.004 | 0.031 | 1.05 | — | — | — | 0.0010 | — | — | 711 | 886 | 834 | 0.022 |
| $R_4$ | 0.15 | 1.26 | 1.54 | 0.001 | 0.002 | 0.004 | 0.031 | 1.05 | 0.20 | — | — | 0.0010 | — | — | 761 | 894 | 854 | 0.022 |

TABLE 11-continued

| Steel type | Component (mass %) C | Si | Mn | P | S | N | Al | Cr | Mo | Cu | Ni | Ca | Mg | Others | Ac1 (° C.) | Ac3 (° C.) | 0.3Ac1 + 0.7Ac3 (° C.) | f (%) |
|---|---|---|---|---|---|---|---|---|---|---|---|---|---|---|---|---|---|---|
| $S_4$ | 0.15 | 1.26 | 1.54 | 0.001 | 0.002 | 0.004 | 0.030 | 1.00 | — | 0.40 | — | 0.0010 | — | — | 760 | 888 | 849 | 0.022 |
| $T_4$ | 0.15 | 1.25 | 1.55 | 0.001 | 0.002 | 0.004 | 0.031 | 1.01 | — | — | 0.50 | 0.0010 | — | — | 751 | 880 | 841 | 0.022 |
| $U_4$ | 0.15 | 1.22 | 1.56 | 0.001 | 0.002 | 0.004 | 0.030 | 1.03 | — | — | — | — | 0.0010 | — | 759 | 886 | 848 | 0.022 |
| $V_4$ | 0.15 | 1.21 | 1.51 | 0.001 | 0.002 | 0.004 | 0.030 | 1.03 | — | — | — | — | — | B: 0.0010 | 759 | 885 | 848 | 0.022 |
| $W_4$ | 0.15 | 1.18 | 1.53 | 0.001 | 0.002 | 0.004 | 0.030 | 0.99 | — | — | — | — | — | REM: 0.0010 | 758 | 884 | 846 | 0.022 |

(*Indicating departure from the range according to the present invention. REM refers to a total amount of Ce, La, Nd, and Pr.)

TABLE 12

| Heat treatment | Annealing condition: Heating temperature (° C.) | Retention time (s) | First cooling rate (° C./s) | First cooling completion temperature (° C.) | Second cooling rate (° C./s) | Second cooling completion temperature (° C.) | Tempering condition: Heating temperature (° C.) | Retention time (s) | Parameters: P |
|---|---|---|---|---|---|---|---|---|---|
| $a_4$ | 900 | 120 | 20 | 675 | 200 | 20 | 530 | 180 | $1.1 \times 10^{-3}$ |
| $b_4$ | 900 | 120 | — | — | 200 | 100 | 530 | 180 | $1.1 \times 10^{-3}$ |
| $c_4$ | 900 | 120 | 20 | 675 | 200 | 20 | 500* | 300 | $1.1 \times 10^{-3}$ |
| $d_4$ | 900 | 120 | 20 | 675 | 200 | 20 | 530 | 10 | $6.0 \times 10^{-5}$* |
| $e_4$ | 900 | 120 | 20 | 600* | 200 | 20 | 530 | 180 | $1.1 \times 10^{-3}$ |
| $f_4$ | 900 | 120 | 20 | 675 | 200 | 20 | 600 | 180 | $2.9 \times 10^{-3}$* |
| $g_4$ | 800* | 120 | 20 | 675 | 200 | 20 | 530 | 180 | $1.1 \times 10^{-3}$ |
| $h_4$ | 900 | 120 | 20 | 690 | 200 | 20 | 530 | 150 | $9.1 \times 10^{-4}$ |

(*Indicating departure from the recommended range according to the present invention.)

In accordance with the respective measuring methods described under the heading [BEST MODE FOR CARRYING OUT THE INVENTION], measurements for an area ratio of tempered martensite, an average diameter Dθ(μm) of an equivalent circle of cementite, and a calorific value in a range of 400 to 600°C. as measured by a differential scanning calorimeter (DSC), respectively, were made on the respective steel sheets with the heat treatment applied thereto.

Further, measurments for yield strength YP, elongation El, and stretch flangeability λ, A test piece referred to as No. 5 test piece in JIS Z 2201 , with its long axis oriented in a direction at right angles to a rolling direction, was prepared, and measurements for yield strength YP, and elongation El, respectively, were made on the test piece in accordance with JIS Z 2241 . Further, stretch flangeability λwas found by conducting a hole expanding test according to Iron and Steel federation specification JFST 1001 , thereby measuring a hole expanding ratio. Table 13 shows results of those measurements.

TABLE 13

| Steel No. | Steel type | Heat treatment | Tempered martensite area ratio (%) | Ferrite area ratio (%) | Other structure area ratio (%) | Dθ (mm) | $(0.9f^{1/2} - 0.8) \times D\theta$ | Calorific value generated between 400~600° C. as measured by DSC (J/g) | YP (MPa) | El (%) | λ (%) | Remarks |
|---|---|---|---|---|---|---|---|---|---|---|---|---|
| 91 | $A_4$ | $a_4$ | 85 | 15 | 0 | 0.075 | 0.38 | 0.21 | 950 | 12.1 | 92 | Working example |
| 92 | $B_4$ | $a_4$ | 85 | 15 | 0 | 0.154 | 0.80* | 0.18 | 750* | 12.0 | 94 | Comparative example* |
| 93 | $C_4$ | $a_4$ | 85 | 15 | 0 | 0.104 | 0.54 | 0.25 | 920 | 11.2 | 97 | Comparative example* |
| 94 | $D_4$ | $a_4$ | 85 | 15 | 0 | 0.095 | 0.48 | 0.21 | 948 | 12.3 | 105 | Working example |
| 95 | $E_4$ | $a_4$ | 0* | 100 | 0 | 0.073 | 0.38 | 0.18 | 970 | 12.2 | 115 | Comparative example* |
| 96 | $F_4$ | $a_4$ | 0* | 100 | 0 | 0.050 | 0.29 | 0.13 | 950 | 11.3 | 120 | Comparative example* |
| 97 | $G_4$ | $a_4$ | 70 | 10 | 20* | 0.029 | 0.16 | 0.12 | 970 | 14.5 | 23* | Comparative example* |
| 98 | $H_4$ | $a_4$ | 60* | 40 | 0 | 0.080 | 1.80* | 0.02 | 470* | 25.0 | 130 | Comparative example* |
| 99 | $I_4$ | $a_4$ | 75 | 25 | 0 | 0.075 | 0.47 | 0.21 | 905 | 12.5 | 103 | Working example |
| 100 | $J_4$ | $a_4$ | 90 | 10 | 0 | 0.087 | 0.34 | 0.69 | 1020 | 10.8 | 90 | Working example |
| 101 | $K_4$ | $a_4$ | 100 | 0 | 0 | 0.082 | 0.26 | 1.11* | 1175 | 7.2* | 52* | Comparative example* |
| 102 | $L_4$ | $a_4$ | 72 | 28 | 0 | 0.079 | 0.41 | 0.18 | 903 | 11.8 | 91 | Working example |
| 103 | $M_4$ | $a_4$ | 30* | 70 | 0 | 0.078 | 0.39 | 0.19 | 780* | 11.2 | 21* | Comparative example* |
| 104 | $N_4$ | $a_4$ | 35* | 65 | 0 | 0.084 | 0.44 | 0.21 | 650* | 15.0 | 30* | Comparative example* |
| 105 | $O_4$ | $a_4$ | 75 | 25 | 0 | 0.086 | 0.45 | 0.19 | 905 | 13.1 | 90 | Working example |
| 106 | $P_4$ | $a_4$ | 100 | 0 | 0 | 0.079 | 0.40 | 0.20 | 1100 | 10.2 | 102 | Working example |
| 107 | $Q_4$ | $a_4$ | 60* | 0 | 40* | 0.081 | 0.42 | 0.19 | 840* | 21.0 | 30* | Comparative example* |
| 108 | $R_4$ | $a_4$ | 95 | 5 | 0 | 0.070 | 0.37 | 0.20 | 1060 | 11.0 | 101 | Working example |

TABLE 13-continued

| Steel No. | Steel type | Heat treatment | Tempered martensite area ratio (%) | Ferrite area ratio (%) | Other structure area ratio (%) | Dθ (mm) | $(0.9f^{1/2} - 0.8) \times$ Dθ | Calorific value generated between 400~600° C. as measured by DSC (J/g) | YP (MPa) | EI (%) | λ (%) | Remarks |
|---|---|---|---|---|---|---|---|---|---|---|---|---|
| 109 | $S_4$ | $a_4$ | 95 | 5 | 0 | 0.066 | 0.34 | 0.18 | 1005 | 11.8 | 106 | Comparative example* |
| 110 | $T_4$ | $a_4$ | 95 | 5 | 0 | 0.066 | 0.35 | 0.20 | 1020 | 12.0 | 102 | Working example |
| 111 | $U_4$ | $a_4$ | 85 | 15 | 0 | 0.073 | 0.38 | 0.21 | 920 | 11.7 | 100 | Working example |
| 112 | $V_4$ | $a_4$ | 100 | 0 | 0 | 0.081 | 0.42 | 0.21 | 1000 | 10.3 | 106 | Working example |
| 113 | $W_4$ | $a_4$ | 85 | 15 | 0 | 0.087 | 0.38 | 0.19 | 960 | 11.5 | 112 | Working example |
| 114 | $E_4$ | $b_4$ | 100 | 0 | 0 | 0.081 | 0.42 | 0.21 | 970 | 10.8 | 106 | Working example |
| 115 | $E_4$ | $c_4$ | 85 | 15 | 0 | 0.087 | 0.46 | 1.04* | 1064 | 8.2* | 82* | Comparative example* |
| 116 | $E_4$ | $d_4$ | 85 | 15 | 0 | 0.076 | 0.40 | 1.12* | 1091 | 7.3* | 60* | Comparative example* |
| 117 | $E_4$ | $e_4$ | 50* | 50 | 0 | 0.076 | 0.40 | 0.18 | 720* | 14.8 | 52* | Comparative example* |
| 118 | $E_4$ | $f_4$ | 85 | 15 | 0 | 0.155 | 0.81* | 0.05 | 811* | 13.2 | 91 | Comparative example* |
| 119 | $E_4$ | $g_4$ | 30* | 70 | 0 | 0.077 | 0.40 | 0.22 | 764* | 13.6 | 66* | Comparative example* |
| 120 | $E_4$ | $h_4$ | 95 | 5 | 0 | 0.070 | 0.40 | 0.32 | 1203 | 10.1 | 98 | Working example |

(*Indicating departure from the range according to the present invention.)

As shown in Table 13, the working examples, Steel Nos. 91, 94, 99, 100, 102, 105, 106, 108, 110, to 114, and 120, each were found having yield strength YP at 900 Mpa or higher, elongation El at 10 % or more, and stretch flangeability (a hole expanding ratio) λat 90 % or more. Accordingly, with those working examples, there was obtained a high-strength cold-rolled steel sheet having both yield strength, and elongation as well as stretch flangeability, meeting the required levels described in the paragraph under the heading BACKGROUND TECHNOLOGY.

In contrast, the comparative examples, Steel Nos. 92, 93, 95to 98, 101, 103, 104, 107, 109, and 115 to 119, each were found inferior in any of characteristics.

For example, with Steel No. 98, since C-content was excessively low, an area ration of tempered martensite was less than 70 %, which was insufficient, and an average interparticle distance of cementite was excessively large. For this reason, Steel No. 98 was found excellent in elongation, and stretch flangeability, but found inferior in yield strength.

Further, with Steel No. 101, since C-content was excessively high, an area ration of tempered martensite 70 % or more was secured, however, not only the hardness of the tempered martensite was excessively high but also an amount of solid solution carbon was excessively large. For this reason, Steel No. 101 was found excellent in yield strength, but found inferior in both elongation, and stretch flangeabiliity.

Further, with Steel No. 103, since Si-content was excessively high, an area ration of tempered martensite was insufficient, so that Steel No. 103 was found excellent in elongation, but was found inferior in yield strength and stretch flangeability.

Further, with Steel No. 104, since Mn-content was excessively low, an area ration of tempered martensite was insufficient, so that Steel No. 104 was found excellent in elongation, but was found inferior in yield strength and stretch flangeability.

Further, with Steel No. 107, since Mn-content was excessively high, residual austenite remained at the time of hardening, (upon cooling after heating for annealing), so that Steel No. 107 was found excellent in elongation, but found inferior in yield strength, and stretch flangeabiliity.

Further, with Steel No. 92, since Cr-content was excessively low, an average interparticle distance of cementite was excessively large, so that , Steel no. 92 was found excellent in elongation, and stretch flangeability, but found inferior in yield strength.

Further, with Steel No. 97, since Cr-content was excessively high, residual austenite was formed at the time of hardening, so that Steel No. 97 was found excellent in yield strength, and elongation, but found inferior in stretch flangeability.

Further, with Steel Nos. 115 to 119, at least one of requirements for controlling the structure according to the fourth aspect of the present invention was not satisfied because of departure of the annealing condition, or the tempering condition from the range recommended by the fourth aspect of the present invention, so that Steel Nos. 115 to 119, each were found inferior in at least one of the yield strength, elongation, and stretch flangeability.

While the invention has been particularly shown and described with reference to specific embodiments thereof, it will be obvious to those skilled in the art that various changes and modification may be made therein without departing from the spirit and scope of the invention.

The following Japanese patent applications, on which this application claims a convention Priority, are incorporated herein by reference:

Japanese Patent Application No. 2008-057319, filed on Mar. 7, 2008;

Japanese Patent Application No. 2008-057320, filed on Mar. 7, 2008;

Japanese Patent Application No. 2008-059854, filed on Mar. 10, 2008;

Japanese Patent Application No. 2008-097411, filed on Apr. 3, 2008.

The invention claimed is:

1. A cold rolled steel sheet having a composition comprising, by mass %:

0. 03 to 0.30% of C;

0. 1 to 5.0% of Mn;

not more than 0.1% of P;

less than 0.01% of S;

not more than 0.01% of N;

0. 01 to 1.00% of Al; and 0.5 to 3.0% of Si, wherein the cold rolled steel sheet further has a structure comprising tempered martensite with an area ratio of not less than 50%, including 100%, and ferrite comprised in the balance of the structure, wherein at least one structure factor selected from the group consisting of cementite particles in the tempered martensite, ferrite grains, and dislocation density of the whole structure, is controlled, wherein;

the tempered martensite has a hardness of not more than 380 Hv;

the number of cementite particles having a diameter of an equivalent circle of 0.1 μm or more, present in the tempered martensite, is not more than 2.3 pieces per 1 $\mu m^2$ of the tempered martensite; and the number of inclusions having an aspect ratio of not less than 2.0, present in the whole structure, is not more than 200 pieces per 1 $mm^2$.

2. The cold rolled steel sheet according to claim 1, wherein the composition comprises, by mass %, 0.01 to 1.0% of Cr.

3. The cold rolled steel sheet according to claim 1, wherein the composition comprises, by mass %, 0.01 to 1.0% of Mo.

4. The cold rolled steel sheet according to claim 1, wherein the composition comprises, by mass %, 0.05 to 1.0% of Cu, and/or 0.05 to 1.0% of Ni.

5. The cold rolled steel sheet according to claim 1, wherein the composition comprises, by mass %, 0.0005 to 0.01% of Ca, and/or 0.0005 to 0.01% of Mg.

6. The cold rolled steel sheet according to claim 1, wherein the composition comprises, by mass %, 0.0002 to 0.0030% of B.

7. The cold rolled steel sheet according to claim 1, wherein the composition comprises, by mass %, 0.0005 to 0.01% of REM.

8. A cold rolled steel sheet having a composition comprising, by mass %:

0. 03 to 0.30% of C;

not more than 3.0% of Si, including 0%;

not more than 0.1% of P;

less than 0.01% of S;

not more than 0.01% of N; and 0.01 to 1.00% of Al; and 0.5 to 5.0% of Mn, wherein the cold rolled steel sheet further has a structure comprising tempered martensite with an area ratio of not less than 50%, including 100%, and ferrite comprised in the balance of the structure, wherein at least one of structure factor selected from the group consisting of cementite particles in the tempered martensite, ferrite grains, and dislocation density of the whole structure, is controlled, wherein the tempered martensite has a hardness of from 330 to 450 Hv;

the tempered martensite has an area ratio of from 50 to 70%;

the maximum grain size of the ferrite has a diameter of an equivalent circle of not more than 12 μm; and a frequency distribution of angles formed between a C-direction, which is a direction at right angles to a rolling direction, and the longitudinal direction of a ferrite grain, varying in increments of 10-degrees, has a maximum value of not more than 18% and a minimum value of not less than 6%.

9. The cold rolled steel sheet according to claim 8, wherein the composition comprises, by mass %, 0.01 to 1.0% of Cr.

10. The cold rolled steel sheet according to claim 8, wherein the composition comprises, by mass %, 0.01 to 1.0% of Mo.

11. The cold rolled steel sheet according to claim 8, wherein the composition comprises, by mass %, 0.05 to 1.0% of Cu, and/or 0.05 to 1.0% of Ni.

12. The cold rolled steel sheet according to claim 8, wherein the composition comprises, by mass %, 0.0005 to 0.01% of Ca, and/or 0.0005 to 0.01% of Mg.

13. The cold rolled steel sheet according to claim 8, wherein the composition comprises, by mass %, 0.0002 to 0.0030% of B.

14. The cold rolled steel sheet according to claim 8, wherein the composition comprises, by mass %, 0.0005 to 0.01% of REM.

15. A cold rolled steel sheet having a composition comprising, by mass %:

0.03 to 0.30% of C;

0.1 to 5.0% of Mn;

not more than 0.1% of P;

less than 0.01% of S;

not more than 0.01% of N;

0.01 to 1.00% of Al; and 0.1 to 3.0% of Si, wherein the cold rolled steel sheet further has a structure comprising tempered martensite with an area ratio of not less than 50%, including 100%, and ferrite comprised in the balance of the structure, wherein at least one structure factor selected from the group consisting of cementite particles in the tempered martensite, ferrite grains, and dislocation density of the whole structure, is controlled, wherein the tempered martensite has a hardness of not more than 380 Hv;

dislocation density in the whole structure is $1\times10^{15}$ to $4\times10^{15}$ $m^{-2}$; and a Si equivalent defined by the expression (1):

$$[\text{Si equivalent}]=[\%\ \text{Si}]+0.36[\%\ \text{Mn}]+7.56[\%\ \text{P}]+0.15[\%\ \text{Mo}]+0.36[\%\ \text{Cr}]+0.43[\%\ \text{Cu}] \quad (1)$$

satisfies the expression (2):

$$[\text{Si equivalent}]\geqq 4.0-5.3\times10^{-8}\sqrt{[\text{dislocation density}]} \quad (2).$$

16. The cold rolled steel sheet according to claim 15, wherein the composition comprises, by mass %, 0.01 to 1.0% of Cr.

17. The cold rolled steel sheet according to claim 15, wherein the composition comprises, by mass %, 0.01 to 1.0% of Mo.

18. The cold rolled steel sheet according to claim 15, wherein the composition comprises, by mass %, 0.05 to 1.0% of Cu, and/or 0.05 to 1.0% of Ni.

19. The cold rolled steel sheet according to claim 15, wherein the composition comprises, by mass %, 0.0005 to 0.01% of Ca, and/or 0.0005 to 0.01% of Mg.

20. The cold rolled steel sheet according to claim 15, wherein the composition comprises, by mass %, 0.0002 to 0.0030% of B.

21. The cold rolled steel sheet according to claim 15, wherein the composition comprises, by mass %, 0.0005 to 0.01% of REM.

22. A cold rolled steel sheet having a composition comprising, by mass %:

0.03 to 0.30% of C;

1 to 5.0% of Mn;

not more than 0.1% of P;

less than 0.01% of S;

not more than 0.01% of N;

0.01 to 1.00% of Al;

0.1 to 3.0% of Si; and 0.5 to 3.0% of Cr, wherein the cold rolled steel sheet further has a structure comprising tempered martensite with an area ratio of not less than 50%, 100% included, and ferrite comprised in the balance of the structure, wherein at least one of structure factor selected from the group consisting of cementite particles in the tempered martensite, ferrite grains, and dislocation density of the whole structure, is controlled, wherein the tempered martensite has an area ratio of not less than 70%, including 100%;

an area ratio f (%) of cementite in the tempered martensite, and an average diameter Dθ(μm) of an equivalent circle of the cementite satisfy the expression (3):

$$(0.9f^{-1/2}-0.8)\times D\theta \geqq 6.5\times 10^{-1} \quad (3),$$

where $f=[\%C]/6.69$; and a calorific value generated between 400 to 600° C., as measured by a differential scanning calorimeter (DSC) is not more than 1 J/g.

23. The cold rolled steel sheet according to claim 22, wherein the composition comprises, by mass %, 0.01 to 1.0% of Mo.

24. The cold rolled steel sheet according to claim 22, wherein the composition comprises, by mass %, 0.05 to 1.0% of Cu, and/or 0.05 to 1.0% of Ni.

25. The cold rolled steel sheet according to claim 22, wherein the composition comprises, by mass %, 0.0005 to 0.01% of Ca, and/or 0.0005 to 0.01% of Mg.

26. The cold rolled steel sheet according to claim 22, wherein the composition comprises, by mass %, 0.0002 to 0.0030% of B.

27. The cold rolled steel sheet according to claim 22, wherein the composition comprises, by mass %, 0.0005 to 0.01% of REM.

* * * * *